US006608617B2

(12) United States Patent
Hoffknecht et al.

(10) Patent No.: US 6,608,617 B2
(45) Date of Patent: Aug. 19, 2003

(54) LIGHTING CONTROL INTERFACE

(76) Inventors: Marc O. Hoffknecht, 1 Pemberton Avenue, Suite 2503, Toronto, Ontario (CA), M2M 4L9; Mark A. Muzzin, 127 Reiner Road, Toronto, Ontario (CA), M3H 2L7

( * ) Notice: Subject to any disclaimer, the term of this patent is extended or adjusted under 35 U.S.C. 154(b) by 97 days.

(21) Appl. No.: 09/849,317

(22) Filed: May 7, 2001

(65) Prior Publication Data

US 2002/0067144 A1 Jun. 6, 2002

Related U.S. Application Data

(60) Provisional application No. 60/202,939, filed on May 9, 2000.

(51) Int. Cl.[7] ..... G09G 5/00

(52) U.S. Cl. ..... 345/173; 345/175; 315/292

(58) Field of Search ..... 315/291–295; 345/8, 44, 173–179

(56) References Cited

U.S. PATENT DOCUMENTS

| | | | | |
|---|---|---|---|---|
| 3,668,467 A | | 6/1972 | Isaac | 315/292 |
| 4,649,323 A | | 3/1987 | Pearlman et al. | 315/307 |
| 4,924,151 A | | 5/1990 | D'Aleo et al. | 315/295 |
| 4,939,428 A | | 7/1990 | DePauli | 315/291 |
| 5,191,265 A | | 3/1993 | D'Aleo et al. | 315/295 |
| 5,235,217 A | | 8/1993 | Kirton | 307/326 |
| 5,248,919 A | | 9/1993 | Hanna et al. | 315/291 |
| 5,530,322 A | | 6/1996 | Ference et al. | 315/295 |
| 5,694,154 A | * | 12/1997 | Knox et al. | 345/173 |
| 5,719,450 A | | 2/1998 | Vora | 307/116 |
| 5,796,183 A | | 8/1998 | Hourmand | 307/116 |
| 5,909,211 A | | 6/1999 | Combs et al. | 345/172 |
| 6,004,049 A | | 12/1999 | Knox | 400/89 |
| 6,262,717 B1 | * | 7/2001 | Donohue et al. | 345/173 |

* cited by examiner

*Primary Examiner*—Don Wong
*Assistant Examiner*—Wilson Lee
(74) *Attorney, Agent, or Firm*—Bereskin & Parr

(57) ABSTRACT

A lighting control interface consisting of a touch pad matrix, a housing, different faceplates having unique graphical designs, and a control circuit. The touch pad matrix has a plurality of conductive touch pads. The faceplate has a plurality of faceplate areas which are used to designate various lighting commands and each faceplate can represent a unique collection of lighting control functions. The control circuit is electrically coupled to the touch pad matrix and is programmed to support the functionality represented by a particular faceplate design by ascribing the appropriate lighting control functions to the individual touch pads. The control circuit includes an oscillator which is coupled to each touch pad in turn and a microcontroller which monitors the frequency of the oscillating circuit when connected to the various touch pads. When a user places a finger on a touch pad, the frequency of the associated oscillations decreases and this decrease in frequency is detected by the microcontroller. Upon detecting the activation of a touch pad, the microcontroller determines which faceplate area has been selected by the user by mapping the touch pad location to the associated faceplate. The microcontroller also detects slow, long and double activations of the faceplate where necessary. A corresponding lighting signal is generated by microcontroller and provided by the lighting control interface either for local dimming purposes of for use within a larger networked lighting environment.

10 Claims, 17 Drawing Sheets

LIGHTING CONTROL INTERFACE

This application claims the benefit of U.S. Provisional Application No. 60/202,939 filed May 9, 2000.

FIELD OF THE INVENTION

The present invention relates generally to lighting control devices and in particular to a programmable lighting control interface.

BACKGROUND OF THE INVENTION

A wide variety of manual light switches are currently commercially available, such the familiar forms of the common toggle light switch, push button switches, and keyboard switches, amongst others. The majority of such switches employ a mechanical contact that "makes" and "breaks" the circuit to be switched as the switch is moved to a closed or an open condition. Mechanical switches have many well known disadvantages, including susceptibility to wear, fatigue and loosening as well as the danger of electrical arcing, A common solution used to achieve a "zero force touch" switch has been to make use of the capacitance of the human user and are known as capacitive touch switches. While the structures of such switches has varied substantially, most include a touch sensor responsive to the capacitance of a touching hand or finger which is sensed and used to control a power device which in turn is used to couple the main power source such as a conventional AC power connection to the lighting system. An example of this kind of switch is disclosed in U.S. Pat. No. 5,235,217 to Kirton which discloses a capacitive touch switch that couples the capacitance of the user into a variable oscillator circuit that outputs a signal having a frequency that varies with the capacitance seen at a touch terminal.

One problem that has arisen from the use of such conventionally available manual and capacitive touch switches is that once installed within a lighting system, it is difficult to vary or add additional controls for additional ballasts or lamps without incurring the expense of installing additional cumbersome switches. Also, there has been increased demand for specialized lighting controls (such as the well-known Scene/Zone lighting schemes used in hotels lobbies and retail displays, etc.) Individual switching devices are not well suited for these purposes and they are not easily integrated with each other and/or with central lighting controlling computers for high level control of lighting environments.

Lighting control systems which are specifically directed to Scene/Zone lighting applications are commercially available. For example, U.S. Pat. No. 4,924,151 to D'Aleo et al. describes a multi-zone, multi-scene lighting control system that controls power to multiple groups of lights and permits power to each group of lights to be adjusted independently and, at the same time, to be stored for later recall. However, this lighting control device contains manual moving parts which are subject to wear, contains relatively expensive components, is not easily retro-fittable within existing lighting installations and is relatively cumbersome to operate.

Thus, there is a need for a lighting control interface which can provide a high level of flexibility and customizability for a particular lighting installation, which can be easily retrofitted into existing lighting installations, and which can be manufactured easily and inexpensively.

BRIEF SUMMARY OF THE INVENTION

It is therefore an object of the present invention to provide an improved lighting control interface.

In one aspect, the present invention provides a lighting control interface comprising:

(a) a touch pad matrix containing a plurality of touch pads;

(b) a programmable device coupled to said touch pad matrix such that said programmable device can be programmed to ascribe a first set and a second set of functions to said touch pads, said first and second sets of functions being different from each other; and (c) said touch pad matrix being capable of receiving at least two different faceplates, one of said faceplates containing a first unique arrangement of graphics that correspond to said first set of functions and another of said faceplates containing a second unique arrangement of graphics that correspond to said second set of functions.

In another aspect, the present invention provides a method of configuring a lighting control interface having a plurality of touch pads coupled to a programmable device, said programmable device being capable of being programmed to ascribe a first set and a second set of functions to said touch pads, said first set and second set of functions being different from each other, said method comprising the steps of:

(a) programming the programmable device to ascribe one of said first set and second set of functions to said touch pads;

(b) creating a first faceplate with a first unique arrangement of graphics corresponding to said one set of functions; and (c) attaching said faceplate over said plurality of touch pads.

Further objects and advantages of the invention will appear from the following description, taken together with the accompanying drawings.

DETAILED DESCRIPTION OF PREFERRED EMBODIMENTS

Figure 1A:
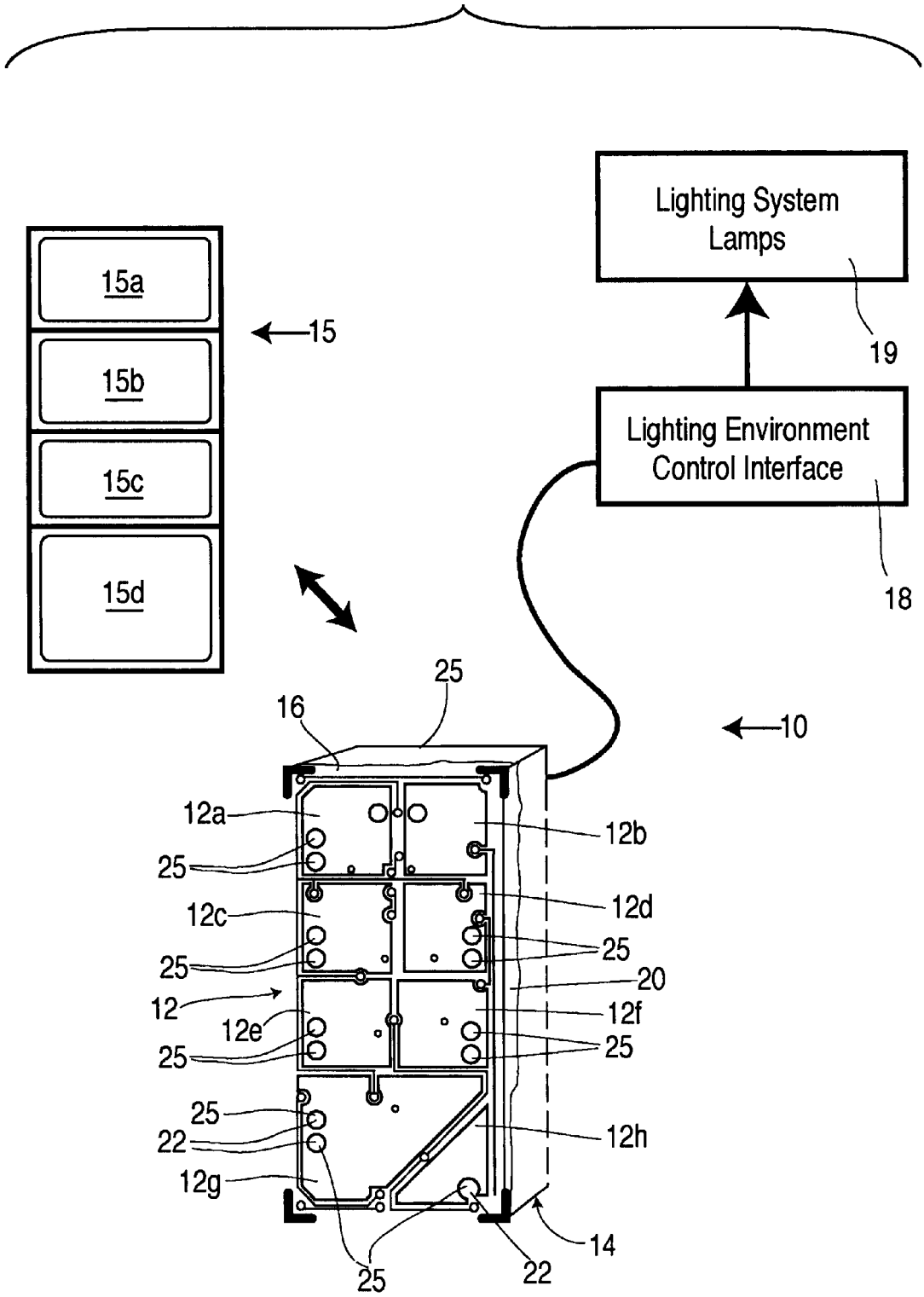
FIG. 1A is a diagrammatic view of a preferred embodiment of a lighting control interface according to the invention installed within a general lighting environment.

Reference is first made to FIG. 1A which shows a lighting control interface 10 made in accordance with a preferred embodiment of the present invention and installed within a conventional lighting environment. Lighting control interface 10 comprises a touch pad matrix 12, a housing 14, a graphical faceplate 15, and a control circuit 16. Lighting control interface 10 provides lighting control signals to a general lighting environment control interface 18 which in turn controls the operation of lighting system lamps 19. Depending on the lighting control functional requirements of a particular lighting installation (e.g. simple ON/OFF functionality or SCENE/ZONE functionality as will be described), lighting control interface 10 can be programmed to support an appropriate graphically designed faceplate 15.

Touch pad matrix 12 is formed on one side (the top side) of a double sided printed circuit board (PCB) 20. Touch pad matrix 12 is comprised of a plurality of individual touch sensitive pads shown as 12*a* to 12*h*, each of which is formed of conventional copper tracks either gold-plated or protected by carbon ink. Touch pad matrix 12 is electrically coupled to control circuit 16 through PCB 20. Control circuit (also shown in FIG. 3) is formed on the other side of PCB 20. When the user touches a touch pad 12*a* to 12*h*, the combined capacitance of the user's finger and touch pad 12*a* to 12*h* will change the state of control circuit 16, as will be described. While touch pad matrix 12 is shown as having eight touch pads, it should be understood that any number of touch pads can be provided and supported by an appropriately designed control circuit 16.

Housing 14 is a rectangular box which is adapted to receive PCB 20 as well as faceplate 50, such that faceplate 15 is disposed above (and in close contact with) touch pad matrix 12. Housing 14 is sized to fit in the front of a conventional light switch mounting box or within a conventional light switch opening. Accordingly, lighting control interface 10 can be easily retrofitted into existing conventional lighting installations.

Faceplate 15 is a graphically designed surface positioned over touch pad matrix 12 and having a plurality of faceplate areas on its top side shown as 15*a* to 15*d*. In this case, each faceplate area is positioned over at least one touch pad 12*a* to 12*h*, as shown. While faceplate 15 is shown having four individual faceplate areas 15*a* to 15*d*, it should be understood that faceplate 15 can feature a wide variety of graphical designs each of which can represent a particular lighting control functions, as will be further described.

Control circuit 16 is mounted on the underside of two-sided PCB 20 and is designed to electrically monitor touch pads 12*a* to 12*h* and to determine when a user's finger has contacted one or more of touch pads 12*a* to 12*h*. Control circuit 16 includes a microcontroller (not shown) which is programmed to support the lighting control functionality associated with the particular design graphics printed on the associated faceplate 15. It should be understood that control circuit 16 can be programmed to support a wide variety of lighting control functionality and a wide variety of associated graphical faceplates 15.

Control circuit 16 also includes a number of indicating LEDs 25 which provide a visual indication of lighting control settings selected by the users during use, as will be further described. The LEDs 25 are reverse-mounted mounted and soldered to the underside of PCB 20 and are oriented within circular holes 22 formed within the individual touch pads 12*a* to 12*h* to provide LED visual indications in association with individual touch pads 12*a* to 12*h*. In addition, control circuit 16 contains a piezo buzzer (not shown) which provides audible indications to the user.

Generally, when the user touches one of the faceplate areas 15*a* to 15*d*, the corresponding touch pad(s) 12*a* to 12*h* of touch pad matrix 12 which is/are positioned directly below the touched faceplate area is/are also contacted by the user's finger. The resulting change in the overall circuit capacitance of the circuit associated with the touched touch pad(s) 12*a* to 12*h* is sensed by control circuit 16. Once control circuit 16 determines which touch pad 12*a* t 12*h* has been activated, control circuit 16 then determines which faceplate area was selected by the user and generates the appropriate lighting control signal for transmission to lighting environment control interface 18. Control circuit 16 can also be configured to sense other types of user input information (i.e. short, long or double touches) and to use such input information to generate the appropriate lighting control signal.

Generally, the graphical design printed on faceplate 15 reflects a particular type of lighting control functionality and control circuit 16 is appropriately programmed to support this particular lighting control functionality. It should be understood that faceplate 15 can have a wide variety of graphical designs and that in each case control circuit 16 would be programmed to implement the particular functionality represented by the particular graphical design of faceplate 15. In this way, it is possible to adapt lighting control interface 10 to a new lighting environment (i.e. where additional user command functionality is required) through the simple process of redesigning faceplate 15 to include the additional set of commands and by re-programming the microcontroller of control circuit 16 to appropriately read and implement the additional set of commands from faceplate 15. One set of commands corresponding to one faceplate 15 differs from another set of commands corresponding to another faceplate 15 even if only one command (i.e. one button or button sequence) is different.

While the lighting control interface 10 is discussed as a single unit, it should be understood that a plurality of lighting control interfaces 10 can be networked together and adapted to communicate (i.e. via a RS485 serial communication line) with a central computer. That is, lighting control interface 10 can be used either for local dimming applications or as one command input device within a networked centralized computer-based lighting system. The central computer can receive lighting commands from each lighting control interface 10 and possible from other devices (e.g. light sensors mounted on windows, timing circuits, etc.) to provide a richer set of lighting control commands to lighting ballasts within a lighting environment (e.g. preferably at the power distribution panel).

Figure 1B:
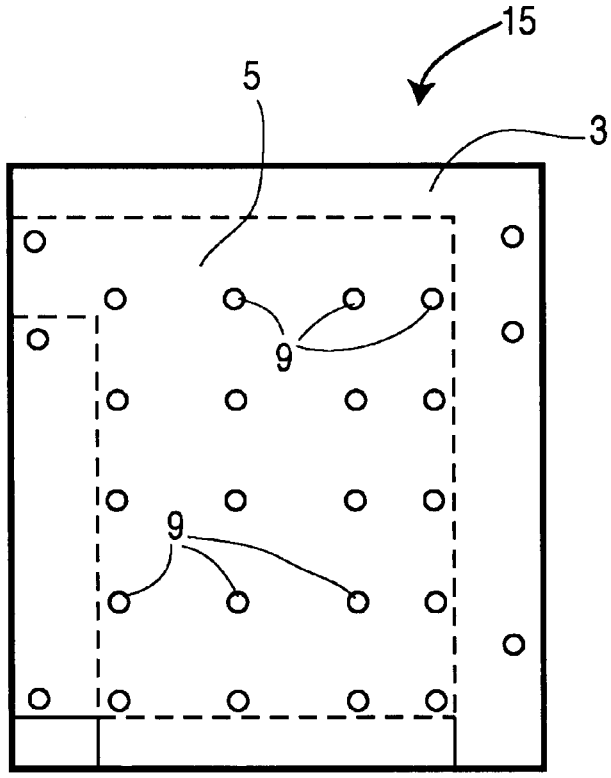
FIGS. 1B and 1C are views of the underside surfaces of faceplate of the lighting control interface of FIG. 1A at two stages of manufacture.
Figure 1C:
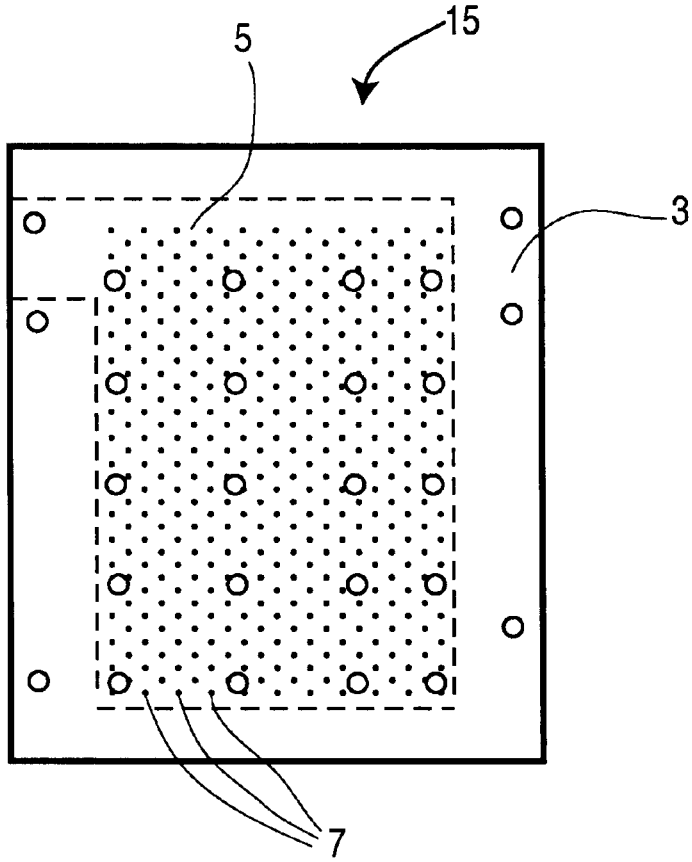

FIGS. 1B and 1C are views of the underside surfaces of faceplate 15 illustrating two stages of manufacture. Specifically, FIG. 1B shows faceplate 15 comprising a clear flexible sheet 3 on which is printed a conductive material layer 5 (e.g. silver or carbon ink) in a particular pattern. It should be noted that conductive material layer 5 is printed on sheet 3 such that openings 9 are left for LEDs 25 of control circuit 16 to shine through. Preferably, sheet 3 is a sheet of thin flexible plastic (e.g. Mylar™) for easy positioning within housing 14 touch pad matrix 12 (e.g. inserted and removed or electrostatically held within housing 12, etc.) However, it should be understood that sheet 3 can alternatively consist of some other material (e.g. paper) and permanently affixed (e.g. glued) to housing 14 over touch pad matrix 12. FIG. 1C illustrates the next manufacturing step where a layer of small dots 7 (e.g. having diameter on the order of 0.3 millimeters and height on the order of micrometers) of dielectric material are printed onto conductive material layer 5. Dots 7 are spaced apart at an approximate distance of 5 millimeters and together form a dielectric layer which acts as a spacer.

Figure 1E:
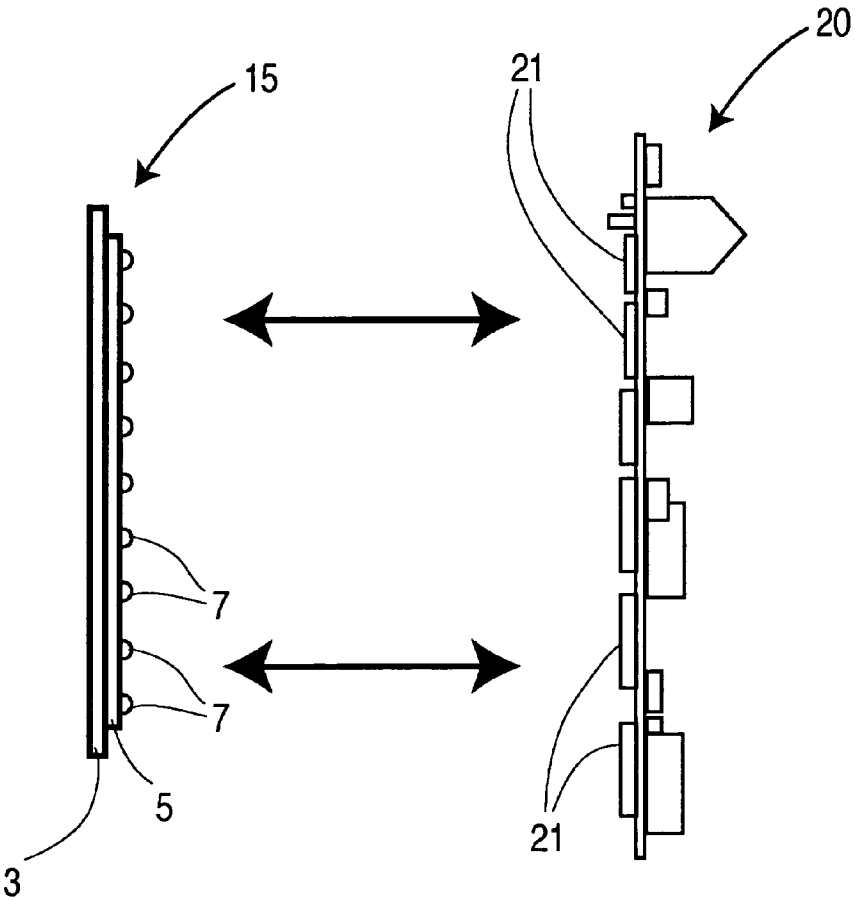
FIG. 1E is a side view of the faceplate and the printed circuit board of the lighting control interface of FIG. 1 showing the interface between the underside of the faceplate and the top side of the printed circuit board of the lighting control interface of FIG. 1A.
Figure 1D:
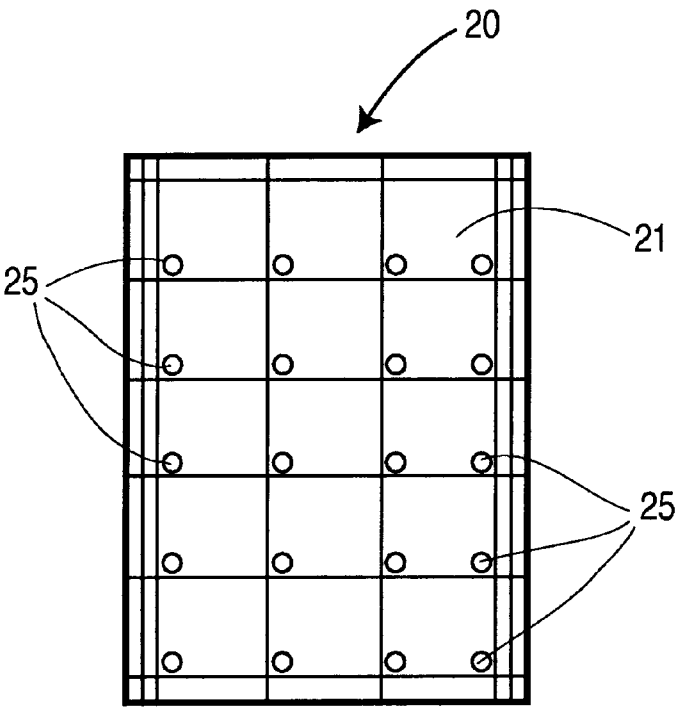
FIG. 1D is a front view showing the top side of the printed circuit board of the lighting control interface of FIG. 1A.

FIG. 1D is a front view showing the top side of printed circuit board 20 with another exemplary matrix of individual touch sensitive pads 21, each of which are conventional copper tracks, either gold plated or protected by carbon ink. Also shown, are LEDs 25 which are positioned in the corners of touch sensitive pads 21 through holes formed within printed circuit board 20 itself. As discussed, LEDs 25 are accommodated within faceplate 15 by openings 9 formed within conductive material layer 5.

FIG. 1E is a side view of faceplate 15 and the printed circuit board 20 where the underside of faceplate 15 and the top side of the printed circuit board 20 are directly coupled to each other. The mechanical deflection of sheet 3 (i.e. mylar film) by a finger causes an alteration in the capacitance sensed by touch sensitive pads 21. The mechanical deflection of sheet 3 has been observed to be as little as on the order of micrometers (i.e. the thickness of the spacer dielectric).

It has been observed that this particular combination of elements produces a user touch pad assembly that is immune to conventional levels of radiated electromagnetic emissions in the environment. Also, the assembly comprising touch pad matrix 12 and faceplate 15 can be manufactured at a substantially lower price than conventional integrated capacitive touchpads.

Figure 2:
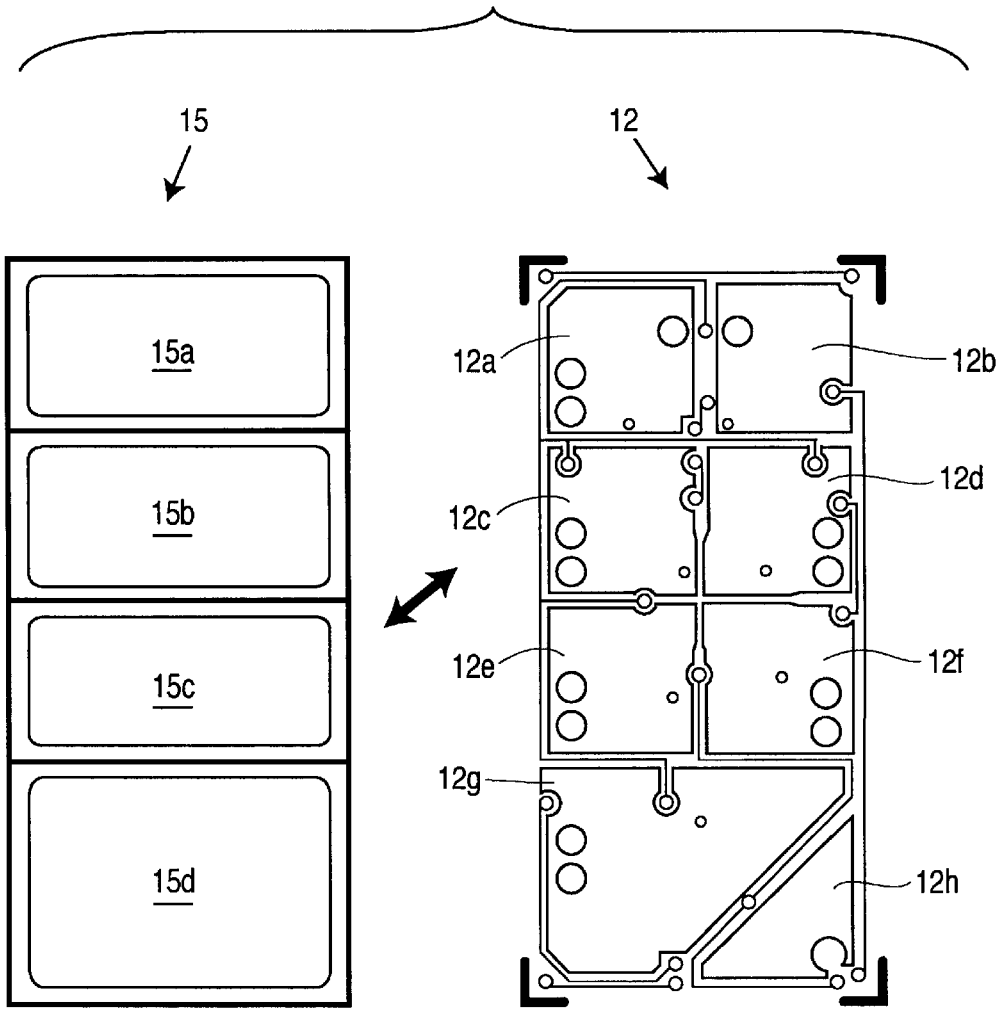
FIG. 2 is a more detailed front view of the touch pad matrix of the lighting control interface of FIG. 1A.
Figure 3A:
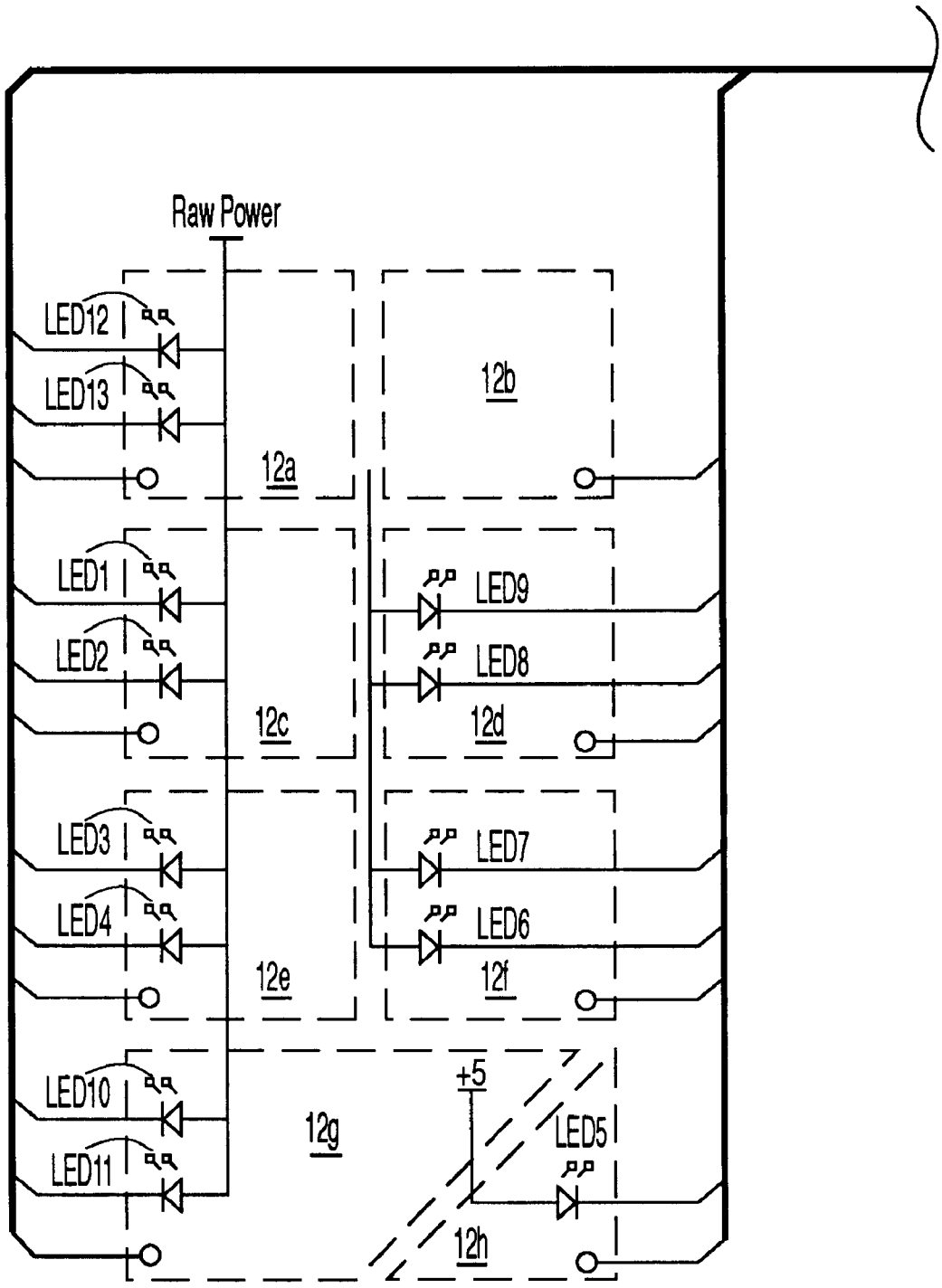
FIG. 3 is a schematic diagram of the control circuit of the lighting control interface of FIG. 1A.
Figure 3B:
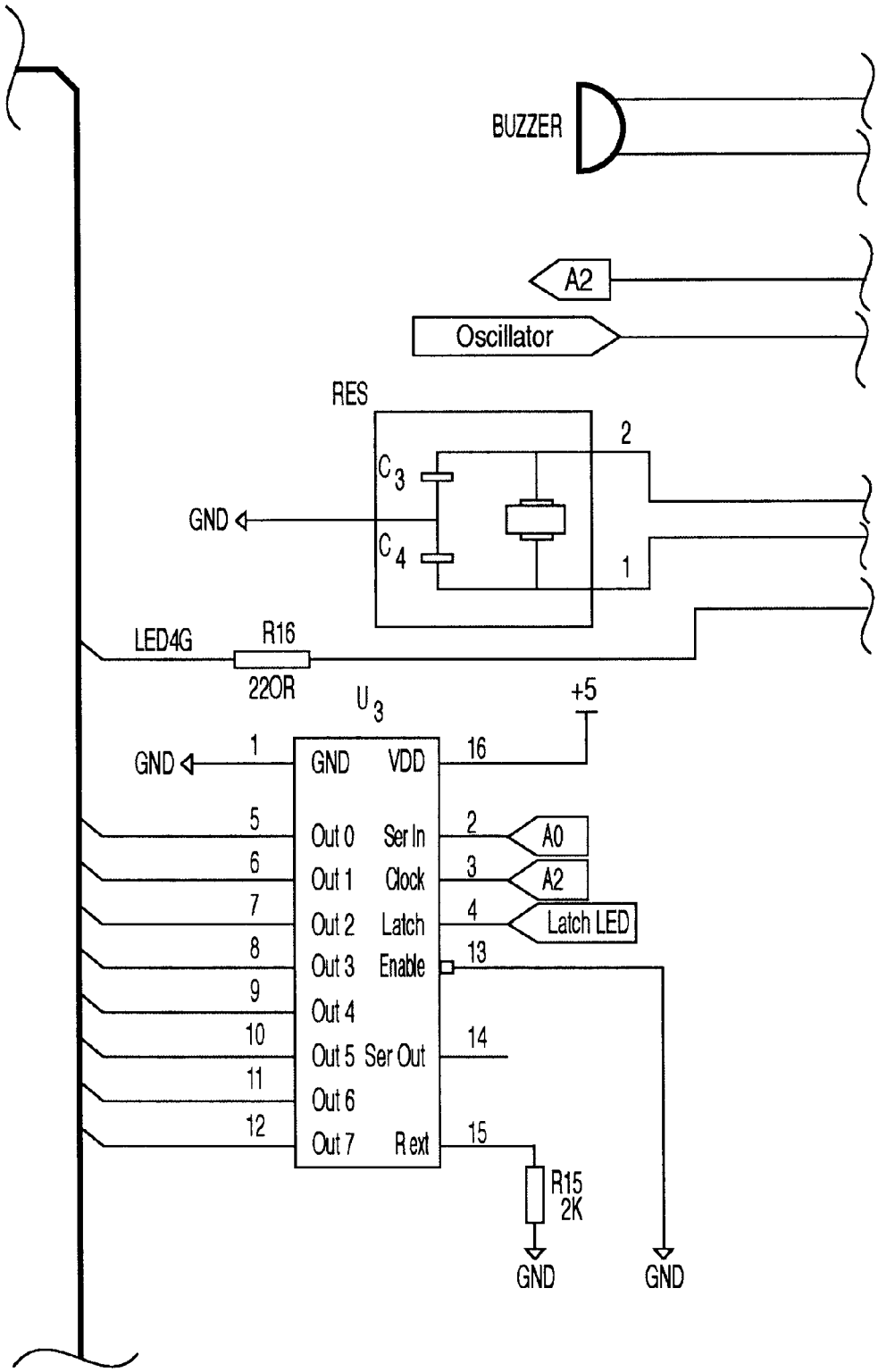
Figure 3C:
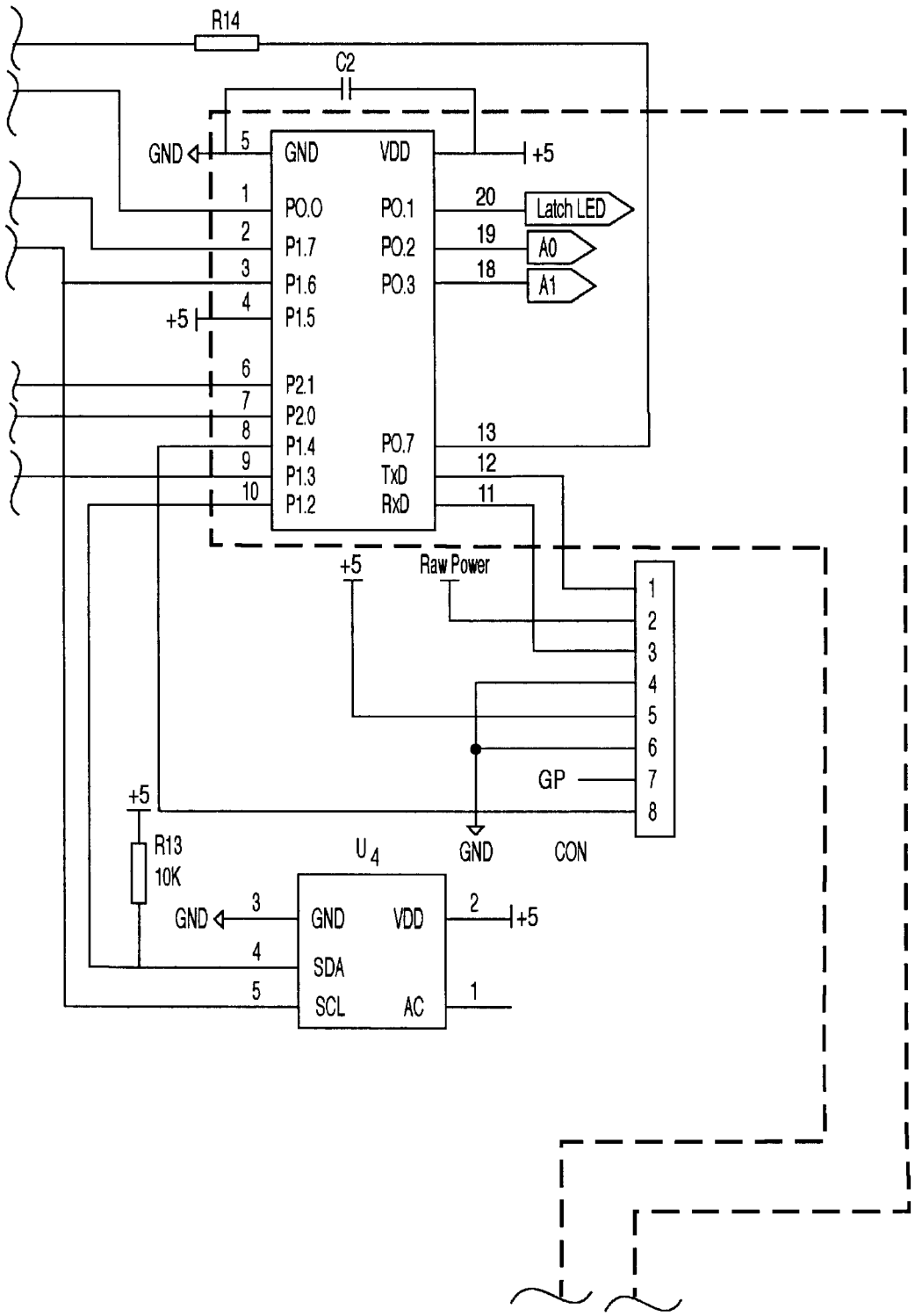
Figure 3D:
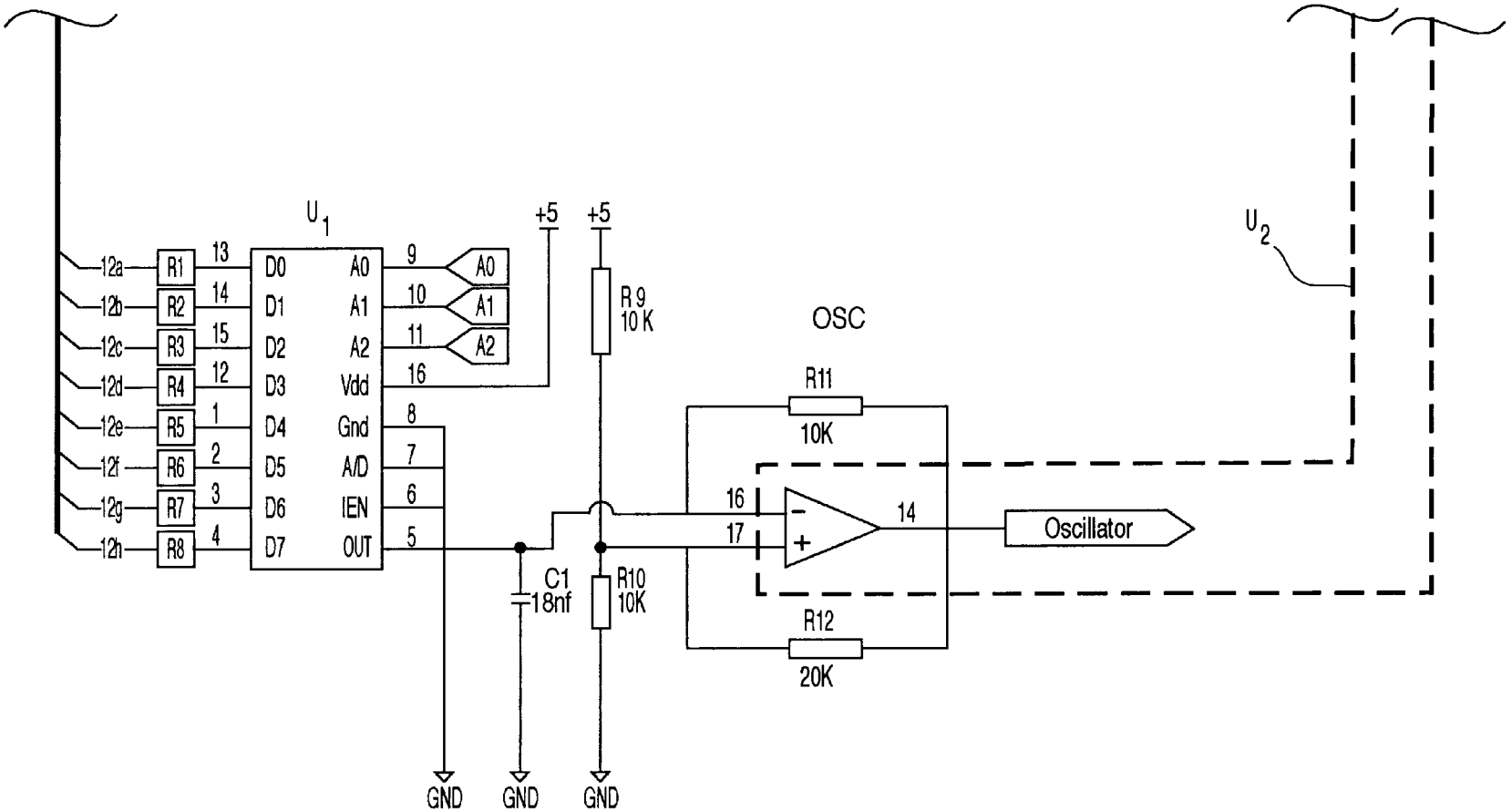

Now referring to FIG. 2, a more detailed view of touch pad matrix 12 and an associated sample faceplate 15 is shown. As previously discussed, faceplate 15, shown as having faceplate areas 15*a* to 15*d* (in this case), is positioned in close association with individual touch pads 12*a* to 12*h*. Control circuit 16 uses the particular relation between touch pads 12*a* and 12*h* and faceplate areas 15*a* to 15*d* to determine which faceplate area 15*a* to 15*d* has been selected by the user when particular touch pads 12*a* to 12*h* have been touched by the user.

Specifically, a mapping table for the touch pad matrix 12 and faceplate 15 combination shown in FIG. 2 would be:

| Touch Pad | Faceplate Area | Touch Pad | Faceplate Area |
|---|---|---|---|
| 12a | 15a | 12e | 15c |
| 12b | 15a | 12f | 15c |
| 12c | 15b | 12g | 15d |
| 12d | 15b | 12h | 15d |

It has been determined that it is possible to position individual touch pads 12*a* to 12*h* relatively close together (e.g. approximately 0.4 millimeters) while still maintaining the separation needed for proper detection by control circuit 16. While it is possible for a user to activate more than one touch pad 12*a* to 12*h* when they are placed close together (i.e. by pressing a finger on two adjacent touch pads), it has been observed that since users tend to press in the middle of faceplate areas 15*a* to 15*d* this does not readily occur. Even if this does occur, control circuit 16 can be programmed to ascertain when two touch pads have been simultaneously touched by a user and to not act when it is two touch pads positioned below separate faceplate areas.

As previously discussed, a wide variety of lighting control functionality can be implemented within lighting control interface 10 by appropriately designing the graphical features of faceplate 15 and by programming control circuit 16 to support or implement the functionality represented by faceplate 15. In this way, the hardware of lighting control interface 10 can be used to accommodate a wide variety of lighting control functionality, simply by printing the appropriate graphical design for faceplate 15 and suitably programming control circuit 16 to support the functionality represented by faceplate 15.

While touch pads 12*a* to 12*h* are shown, it should be understood that control circuit 16 can be adapted to support any number of individual touch pads within touch pad matrix 12. The greater the number of individual touch pads provided by touch pad matrix 12, the larger the number of control inputs (i.e. the higher the resolution of control inputs) by lighting control interface 10.

Now referring to FIG. 3, the electronic circuitry of control circuit 16 is schematically illustrated in association with individual touch pads 12*a* to 12*h* (shown in dotted outline). It should be understood that the circuitry shown is only one possible embodiment of control circuit 16 and that various other circuit configurations adapted to perform the desired functions can be used in place of the one shown.

Control circuit 16 comprises light emitting diodes $LED_1$ to $LED_{13}$, a multiplexer $U_1$, a microcontroller $U_2$, a LED driver $U_3$, non-volatile memory $U_4$, an oscillating circuit OSC, a resonator circuit RES, a connector unit CON, piezo buzzer BUZZER, resistors $R_1$ to $R_{16}$, and capacitors $C_1$ to $C_4$. As discussed, control circuit 16 is configured to determine changes in the capacitance of the touch pads 12*a* to 12*h*, to determine the intended lighting commands from the user based on the particular location and identity of the faceplate areas, to provide visual and audible feedback to the user (using the LEDs and the buzzer), and to generate appropriate lighting control signals either for local lighting control/dimming purposes or for use in a larger lighting system network.

LEDs $LED_1$, $LED_3$, $LED_5$, $LED_7$, $LED_9$, $LED_{10}$, $LED_{13}$, are green LEDs and are used to indicate one state for each individual touch pad 12*a* to 12*h*. LEDs $LED_2$, $LED_4$, $LED_6$, $LED_8$, $LED_{11}$, $LED_{12}$ are red LEDs and are used to indicate another state for each individual touch pad 12*a* to 12*h*. The LEDs are driven using the available "raw power" source (i.e. provided directly from a transformer output which has been rectified and filtered). LED driver $U_3$ is able to maintain constant LED brightness over a broad range of input voltages due to internal constant current drives.

Multiplexer $U_2$ of the present invention can be a conventional multiplexer such as the analogue multiplexer MM74HC4051 manufactured by Fairchild Semiconductor International of Maine, although it should be understood that any type of multiplexer with similar functionality may be utilized. Multiplexer $U_2$ is used to selectively connect a touch pad 12*a* to 12*h* of touch pad matrix 12 through a corresponding resistor $R_1$ to $R_8$ to a multiplexer input $D_0$ to $D_7$ and finally to the multiplexer output pin OUT (which is connected to microcontroller $U_2$). Microcontroller $U_2$ generates a particular address and instructs multiplexer $U_1$ at address input pins $A_0$ to $A_1$ to connect one of the touch pads 12*a* to 12*h* to the oscillator circuit OSC. Resistors $R_1$ to $R_8$ are used to limit the current provided to the inputs $D_0$ to $D_7$ in the case of static discharge. The output of multiplexer $U_1$ (at pin 3) is provided to pin 16 of microcontroller $U_2$.

Microcontroller $U_2$ of the present invention can be a conventional low-cost microcontroller such as P89LPC764 manufactured by Philips Semiconductor, although it should be understood that any type of logic circuit having similar program memory capacity (i.e. 4 kilobytes) can be used. Storage of program instructions and other static data is provided by a read only memory (ROM), while storage of dynamic data is provided by a random access memory (RAM).

Microcontroller $U_2$ is configured to form an oscillating circuit OSC by forming a conventionally known Schmitt-trigger inverter. Oscillating circuit OSC is formed by appropriately configuring an operational amplifier comparator (at pins 14, 16 and 17 of microcontroller $U_2$) using resistors $R_9$, $R_{10}$, $R_{11}$, $R_{12}$ and capacitor $C_1$. Specifically, resistors $R_9$ and $R_{10}$ form a voltage divider and have relative values so that the voltage at pin 17 of microcontroller $U_2$ alternates between ⅓ and ⅔ of the supply voltage. The alternating voltage at pin 17, is due in part to the fact that the output voltage at pin 14 of microcontroller $U_2$ also affects the voltage at pin 16 through resistor $R_{12}$.

Oscillating circuit OSC operates by alternately charging and discharging capacitor $C_1$ in parallel with a selected touch pad 12*a* to 12*h* through resistor $R_{11}$. That is, when the output voltage at pin 14 is equal to the supply voltage (i.e. +5 volts), the voltage at the positive input (pin 17) will be ⅔ of 5 volts. Since capacitor $C_1$ is in effect parallel to the touch pad 12*a* to 12*h* being evaluated, capacitor $C_1$ will be charged through resistor $R_{12}$. When the voltage at the negative input (pin 16) reaches ⅔ of the supply voltage the comparator will output 0 volts. The voltage at the positive input (pin 17) will then drop to ⅓ of the supply voltage and capacitor $C_1$ will be discharged through $R_{12}$.

The output of oscillator OSC is a digital frequency signal in the range of 70 kHz to 120 kHz. It should be noted that the frequency encodes the capacitive value of the touch pad 12*a* to 12*h* being monitored in an analog fashion. Accordingly, when the user touches the touch pad 12*a* to 12*h*, the capacitive value of the touch pad 12*a* to 12*h* will be altered and the frequency of the signal produced by oscillator OSC will also be altered. This signal is provided to pin 3 of microcontroller $U_2$ for analysis and calibration. For computational efficiency, microcontroller $U_2$ measures the frequency of the signal at pin 3 by recording the duration of time between a predetermined number of pulses and converts (i.e. inverts) the value to a frequency value in Hertz.

LED driver $U_3$ can be implemented using an octal LED driver with serial input such as the TB62705 manufactured by Toshiba of Japan. The inputs SERIN and CLOCK of LED driver $U_3$ receive the signals $A_0$ to $A_2$ from microcontroller $U_2$ and appropriately drive the addressed subset (i.e. up to eight) of the LEDs $LED_1$ to $LED_{13}$. A ninth LED can be driven directly by microcontroller $U_2$ through resistor $R_{16}$. For practical application, a maximum of nine LEDs are required for display purposes through faceplate 15 and accordingly economy of parts can be achieved. However, if additional LEDs are desired to be incorporated within lighting control interface 10 then it would be possible to use a high capability LED driver such as the 16 output LED driver TB62706 manufactured by Toshiba of Japan to drive an additional number of the LEDs.

Non-volatile memory $U_4$ can be implemented using conventionally known memory device. Memory $U_4$ is used in the case where a plurality of lighting control interfaces 18 are networked together as well as to a central controlling computer over an Ethernet network. While it would also be possible to use a DIP switch to set a network ID address for use within an Ethernet or RS485 network, commercially available memory $U_4$ is substantially cheaper and less bulky. Memory $U_4$ is used to store a unique network ID address for an individual lighting control interface 10 unit. It should be noted that it is contemplated that microcontroller $U_2$ be programmed so that a user can establish a network address for the lighting control interface 10 by selecting appropriate faceplate areas.

Resonator circuit RES is a conventionally known ceramic resonator comprises of a piezo element with two capacitors $C_3$ and $C_4$ coupled to ground. Resonator circuit RES is used to clock microcontroller $U_2$ at pins 6 and 7 and has been selected for its favourable frequency tolerance and low cost. Resonator circuit RES is more reliable than typical internal microcontroller clocks and less expensive and smaller than a separate oscillator. Accordingly, lighting control interface 10 can conduct relatively accurate serial communication with other devices.

Piezo buzzer BUZZER provides audible feedback to the user in response to various selections made. Specifically, microcontroller $U_2$ is programmed to provide user with appropriate audible feedback as various faceplate areas 15*a* to 15*d* are selected by the user. Alternatively, a piezo sounder can be used to produce human speech feedback to provide a verbal description of the device and instructions for use.

Connector unit CON can be implemented using a standard connector device by Samtec Inc. of Indiana. Connector CON is used to provide output signals from microcontroller $U_2$ to lighting environment control interface 18 (FIG. 1). Control circuit 16 is designed to ensure that output signals provided from connector unit CON comply with various safety standards (e.g. Iw voltage and proper isolation).

Finally, the following resistor and capacitive values may be used within control circuit 16 of FIG. 3:

| Part Identifier | Value | Part Identifier | Value |
|---|---|---|---|
| $R_1$ to $R_{12}$, $R_{13}$ | 10 kohms | $R_{16}$ | 220 ohms |
| $R_{11}$ | 20 kohms | $C_1$ | 18 pF |
| $R_{14}$ | 3 kohms | $C_2$ | 100 nF |
| $R_{15}$ | 2 kohms | | |

Accordingly, when a user touches a faceplate area (not shown) and activates a touch pad 12*a* to 12*h*, when microcontroller $U_2$ instructs multiplexer $U_1$ to poll the touched touch pad (i.e. as part of the routine sequential polling operation described above), the change in capacitance effected by the user's finger will affect the frequency produced at pin 14 of the oscillating circuit OSC. When microcontroller $U_2$ determines that this frequency has changed sufficiently to indicate contact of a touch pad then microcontroller $U_2$ will execute process steps to determine which faceplate area was contacted by the user and will generate a lighting control signal on the basis of the functionality pre-programmed into lighting control interface 10, reflected in part in the particular graphical design shown on faceplate 15.

Microcontroller $U_2$ can also be programmed to detect faults, i.e. a pad that is touched for an excessive amount of time that is known a priori to be an unlikely mode of operation of two or more pads touched at the same time or in an improper order. Additionally, microcontroller $U_2$ can be used to perform system diagnostics as well. As discussed above, microcontroller $U_2$ also allows for the use of visual indicators such as LEDs and/or annunciators such as a bell or tone generator to confirm the actuation of a given faceplate area 15*a* to 15*d*.

Figure 4A:
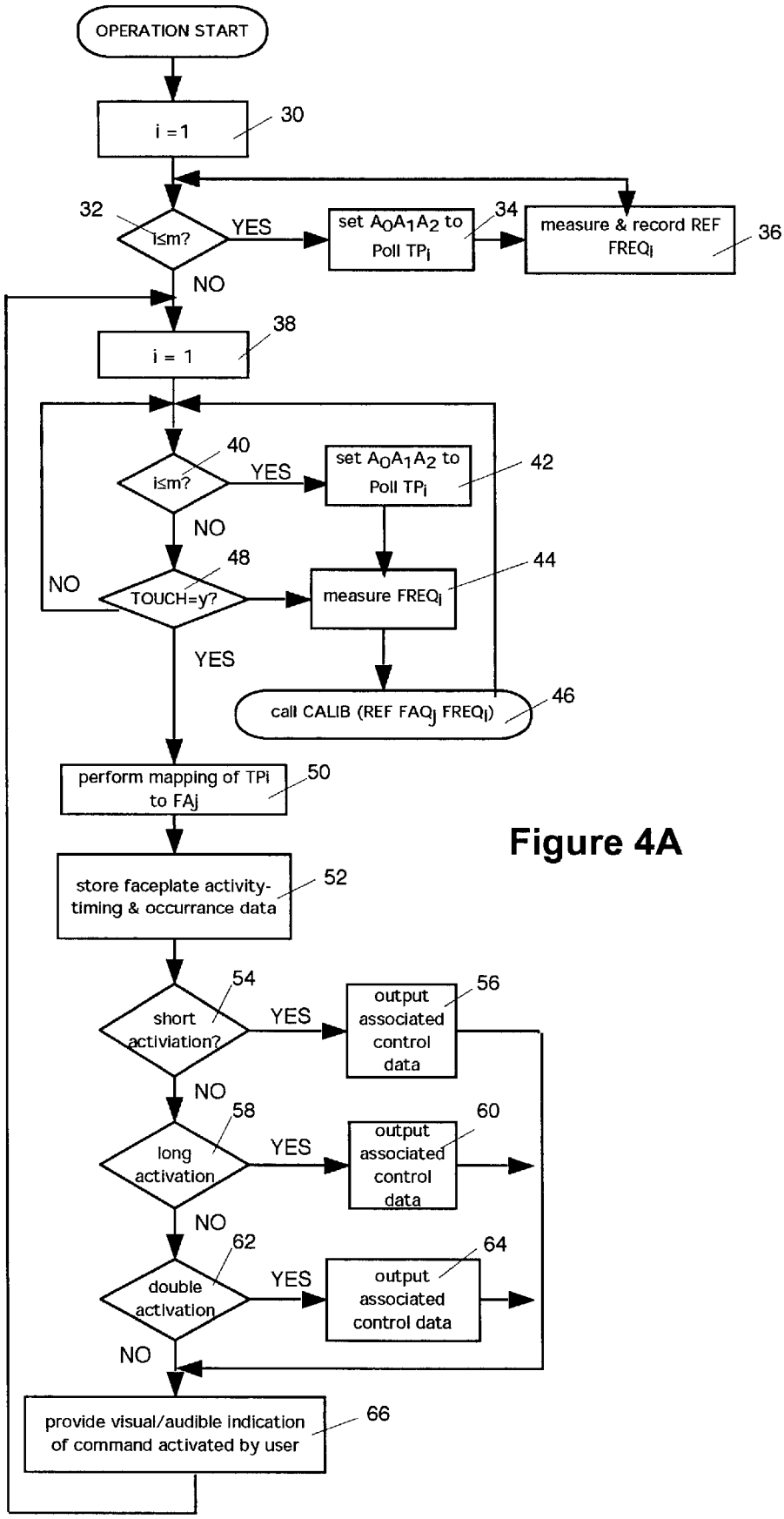
FIG. 4A is a flowchart illustrating the general operational process steps that the microcontroller of the control circuit of FIG. 3 executes to operate lighting control interface.

FIG. 4A shows a flowchart of general OPERATION process steps which are executed by microcontroller $U_2$ to operate lighting control interface 10 where touch pad matrix 12 is comprised of m touch pads $\mathbf{12}_1$ to $\mathbf{12}_m$. As discussed, control circuit 16 monitors changes in capacitance of each touch pad $\mathbf{12}_1$ to $\mathbf{12}_m$ to determine which, or which combination of touch pads $\mathbf{12}_1$ to $\mathbf{12}_m$ have been touched by the user.

When the user powers up lighting control interface 10, the OPERATION process steps are initiated. Microcontroller $U_2$ sequentially generates addresses (at 34) at pins 18, 19 and 20 to sequentially connect each touch pad $\mathbf{12}_1$ to $\mathbf{12}_m$ to the oscillating circuit OSC (at 30 and 32). Microcontroller $U_2$ measures the initial frequency generated across touch pad $\mathbf{12}_1$ to $\mathbf{12}_m$ at start up at pin 14 and records each frequency value in memory as the associated REF FREQ for that touch pad $\mathbf{12}_1$ to $\mathbf{12}_m$ (at 36).

Once all of the REF $FREQ_i$ values have been recorded, microcontroller $U_2$ begins periodic connection of each of the touch pads $\mathbf{12}_1$ to $\mathbf{12}_m$ to the oscillating circuit OSC (at 38 and 40) by providing the appropriate addresses at pins 2, 18 and 19 of microcontroller $U_2$ to pins 9, 10 and 11 of multiplexer $U_1$ (at 42). Microcontroller $U_2$ measures the current frequency $FREQ_i$ of the voltage signal at pin 3 (at 44) for each touch pad $\mathbf{12}_1$ to $\mathbf{12}_m$ and calls the CALIB routine (at 46) to conduct calibration of the currently measured frequency $FREQ_i$. Calibration of touch pad matrix 12 is necessary due to the fact that changes in frequency which occur due to ambient temperature/humidity as well as variances in track lengths and pad sizes all affect the base frequency of the oscillator circuit OSC.

Figure 4B:
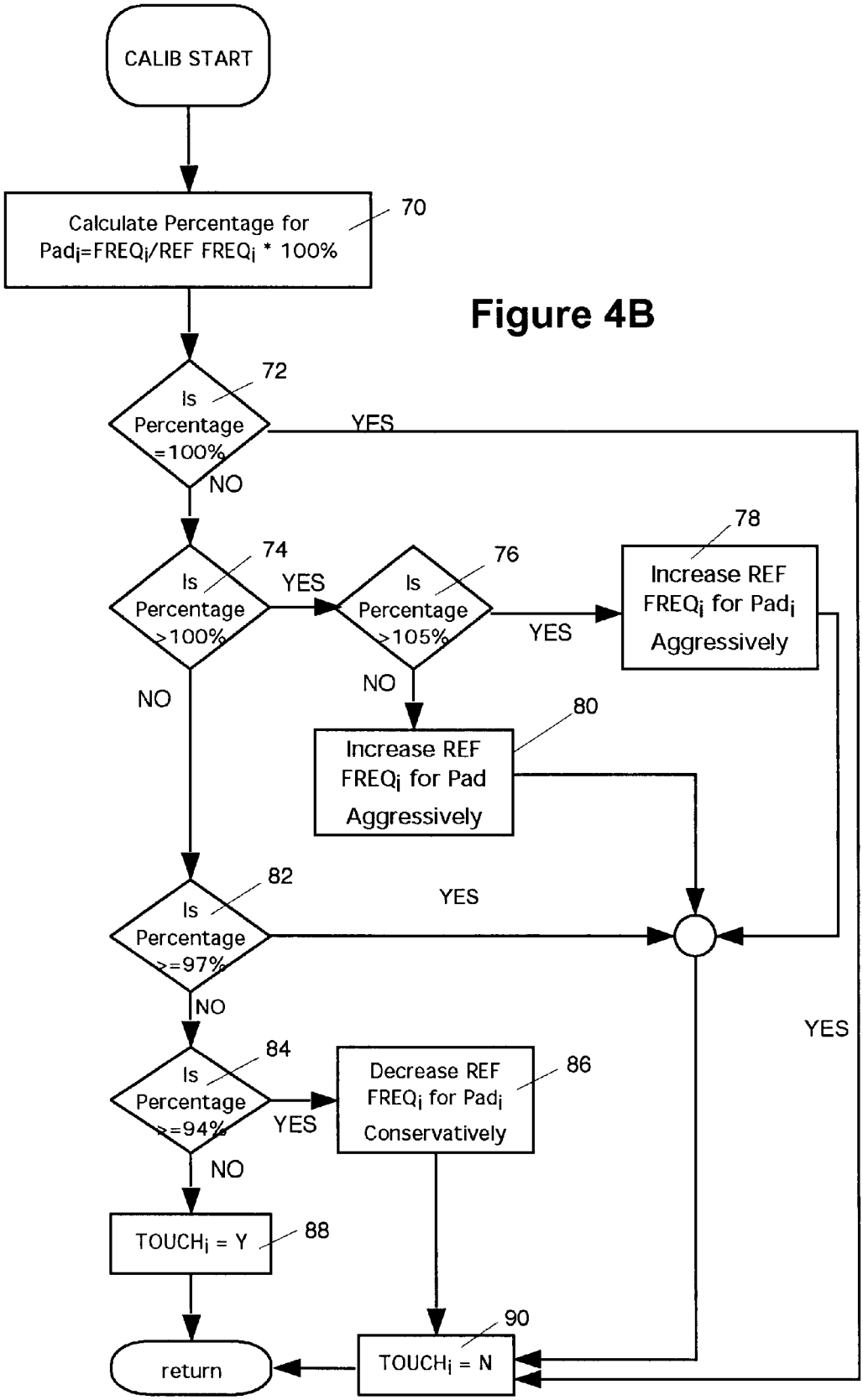
FIG. 4B is a flowchart illustrating the process steps executed by microcontroller of the control circuit of FIG. 3 to achieve dynamic calibration of the touch pad matrix of FIG. 1A.

FIG. 4B is a flowchart illustrating the process steps executed by microcontroller of control circuit to achieve dynamic calibration of touch pad matrix 12. As previously described, when a pad is touched by a user's finger, there is a sudden drop in frequency generated by oscillator circuit OSC and measured at pin 3 of microcontroller $U_2$. Similarly, when the user's finger is removed, there is a sharp increase in frequency generated by oscillator circuit OSC.

By determining whether the current frequency $FREQ_i$ is less than 94% of the reference frequency REF $FREQ_i$ it is possible to determine when a user has touched a touch pad $\mathbf{12}_1$ to $\mathbf{12}_m$. In fact, even in the case where the user puts their finger across two touch pads, it has been observed that the frequency generated by oscillator circuit OSC is still reduced by approximately 50 to 60% of the amount which results from the touching of a single pad, and that this difference can be easily detected using the 94% measure referred to above.

When the CALIB routine is called with the variables reference frequency for the i'th pad, namely REF $FREQ_i$ and the currently measured frequency for pad i, $FREQ_i$. Microcontroller $U_2$ first calculates the percentage relation (at 70):

$$\text{PERCENTAGE} = \frac{FREQ_i}{REF\ FREQ_i} * 100\%$$

It is determined whether PERCENTAGE is 100% (at 72). If so, then the pad is properly calibrated (i.e. the REF $FREQ_i$ is accurate) and has not been touched by the user. However, if PERCENTAGE is not 100% then it is further determined whether PERCENTAGE is larger than 100% (at 74). If so, then either the oscillator circuit OSC has become detuned due to ambient temperature/humidity or the pad was pressed at the time that the touch pad was polled for calibration. In either case, it is further determined whether PERCENTAGE is larger than 105%, in which case the calibrated value for the i'th pad (i.e. REF $FREQ_i$) is aggressively increased (78) in order for PERCENTAGE to return to the 100% target (at a faster rate). Next it is determined that the i'th touch pad has not been contacted by the user's finger (at 90) and the routine returns with the variable TOUCH="N".

If PERCENTAGE is not larger than 100% (at 74) then it is determined whether PERCENTAGE is larger than or equal to 97% (at 82). If this is the case, then the touch pad will still be able to determine if the touch pad has been touched by a user's finger and so to reduce calculation overhead, no action is taken. That is, in this case it is simply determined that the i'th touch pad has not been contacted by the user's finger (at 90) and the routine simply returns with the variable $TOUCH_i$="N".

If PERCENTAGE is not equal to or greater than 97% (at 82) then it is determined whether PERCENTAGE is equal to or greater than 94% (at 84). If so, then the reference frequency REF $FREQ_i$ for the i'th touch pad is decreased conservatively (i.e. to a lesser degree than the reference frequency REF $FREQ_i$ is increased at 78) and it is determined that the i'th touch pad has not been contacted by the user's finger (at 90) and the routine returns with the variable TOUCH="N". However, if the reference frequency REF $FREQ_i$ is less than 94% (i.e. what is currently measured at the touch pad is less than 94% of the reference frequency) then the routine returns the variable $TOUCH_i$="Y".

It should be noted that when lighting control interface 10 is powered up, it is possible that the user will depress one or more of the touch pads $\mathbf{12}_1$ to $\mathbf{12}_m$ while the reference frequency REF $FREQ_i$ reading is taken. Since there is no practical way of ensuring that there is an interval of time where the user does not press any pads, the CALIB routine dynamically determines and updates the reference frequency REF $FREQ_i$ based only on changes between the reference and current frequency values, as will be explained. In the case where a user touches a touch pad when microcontroller $U_2$ is polling the touch pad, the reference frequency REF $FREQ_i$ for the i'th touch pad will be substantially lower than it would be otherwise. When the user releases the touch pad, the associated frequency will suddenly increase. As lighting control interface 10 continues to cycle through the process steps of FIG. 4B, the sudden increase in frequency will result in the aggressive increase of the reference frequency REF $FREQ_i$ (at 78) and After the m touch pads $\mathbf{12}_1$ to $\mathbf{12}_m$ have been polled and calibration for each i'th pad has been achieved, the CALIB routine has returned to the OPERATION routine an array of variables $TOUCH_i$ (for i=1 to m), each other either being "Y" or "N". Microcontroller $U_2$ then reads the array of variables $TOUCH_i$ (for i=1 to m) and for the touch pads $TP_i$ which have been determined to have been touched, performs a mapping of the particular touch pad to the faceplate areas $FA_j$ which is positioned directly above the touch pad at issue (at 50). Specifically, microcontroller $U_2$ executes software instructions which carry out the appropriate mapping from a touch pad $TP_i$ to a faceplate area $FA_j$. Alternatively, it would be possible to store a MAP data table in memory which contains the mapped relationships. Occurrence and associated timing information concerning activation of the faceplate areas $FA_j$ is stored by microcontroller $U_2$ for potential future use (at 52).

Microcontroller $U_2$ then conducts a timing analysis to determine whether touch pad $TP_i$ has been touched by a user's finger for short activation period (at 54), a long activation period (at 56) or whether there has been a double activation (at 58). As is conventionally known in computer interface devices, the double activation speed depends upon the user. Typically, microcontroller $U_2$ assumes that there would be a 0.5 second delay between the taps with generally good results.

Figure 5A:
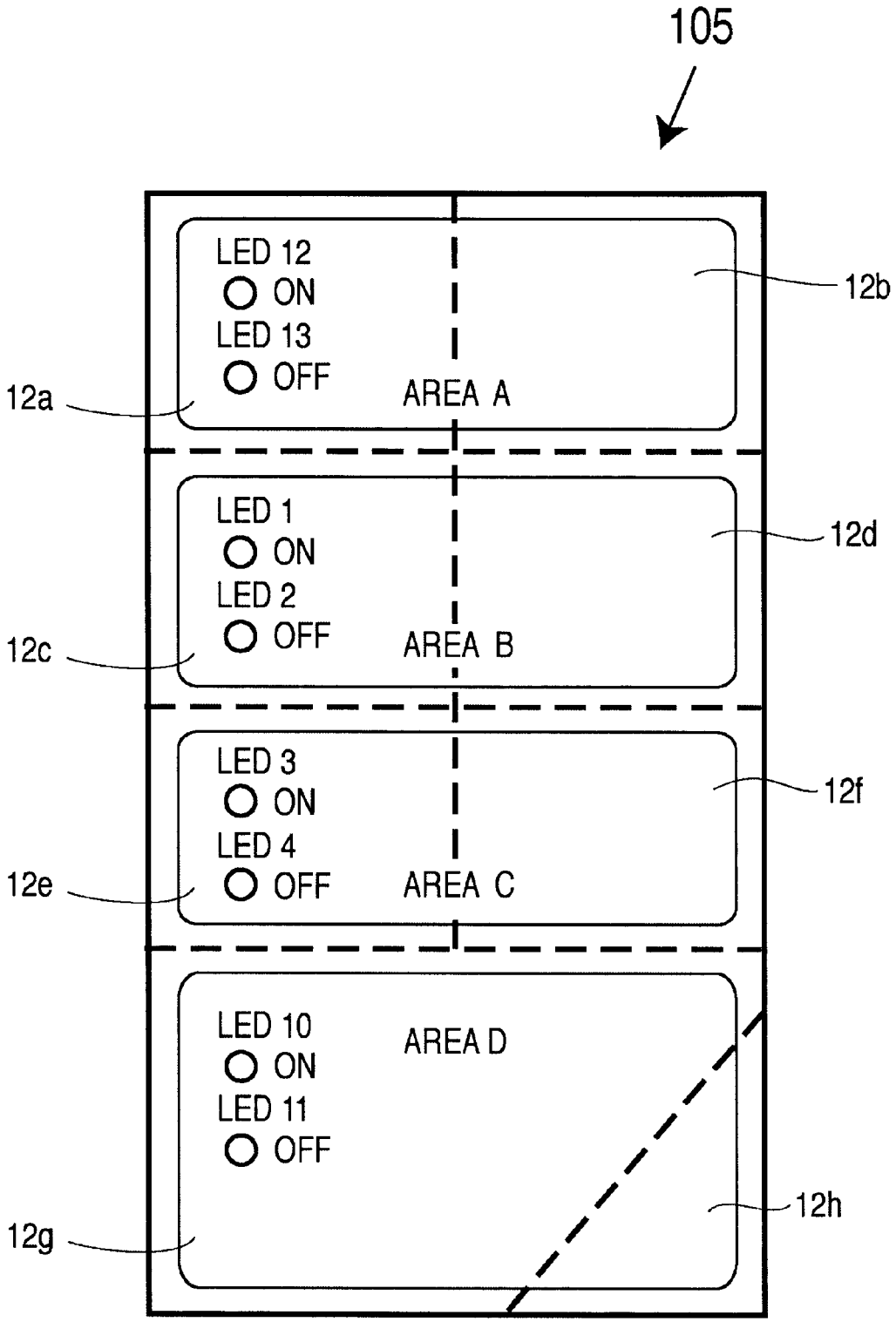
FIG. 5A is one possible faceplate graphical design for the lighting control interface of FIG. 1A.
Figure 5B:
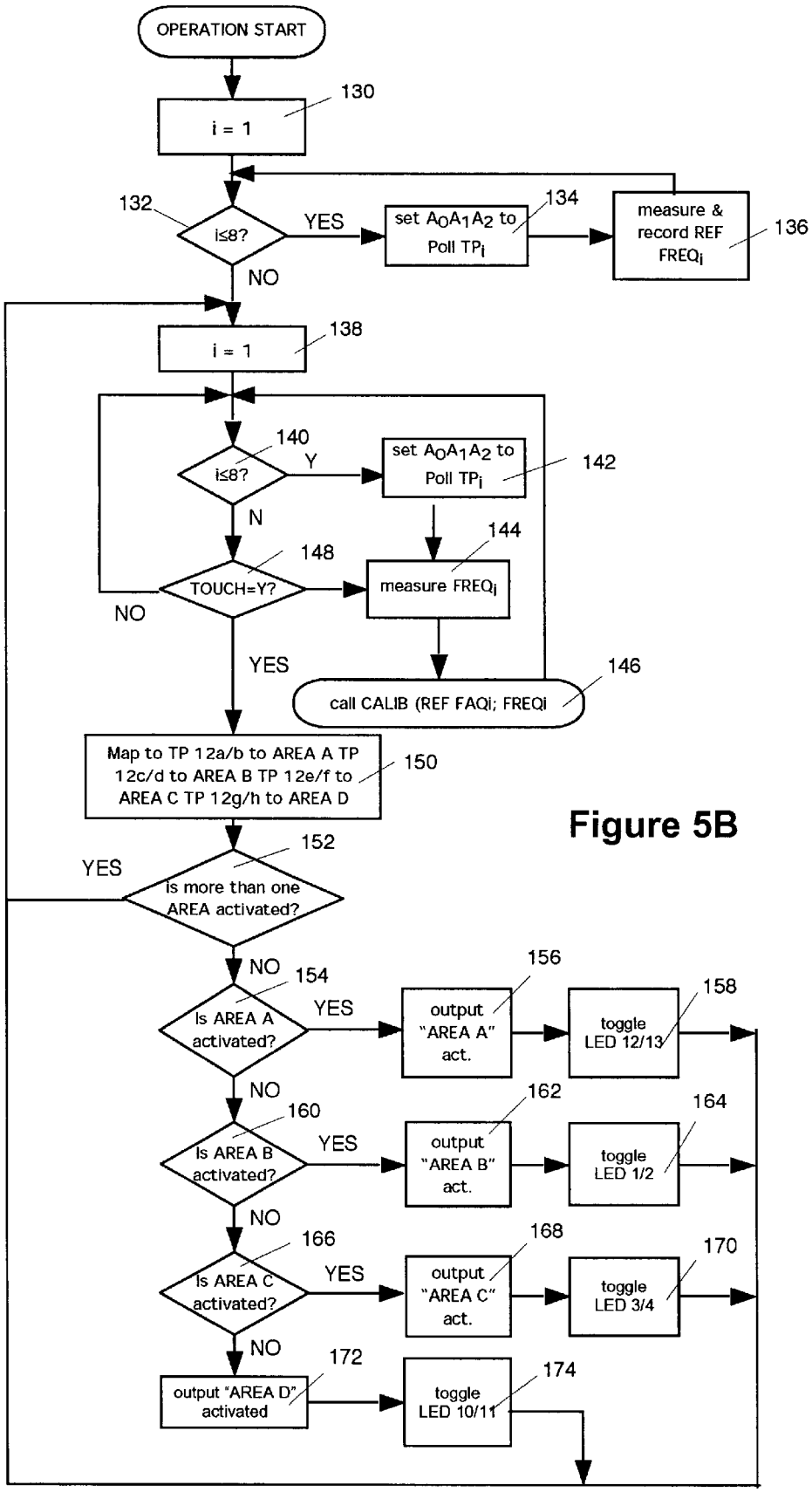
FIG. 5B is a flowchart illustrating the specific operational process steps executed by the microcontroller in order to implement the required functionality for the faceplate of FIG. 5A.

FIGS. 5A and 5B illustrate an exemplary switching faceplate 105 which illustrates how the present invention can be used to provide the customized lighting control functionality of a simple ON/OFF lighting control protocol. Faceplate 105 is comprised of four individual faceplate areas AREA A, AREA B, AREA C, and AREA D, each of which are shown overlain on touch pad matrix 12 (the individual touch pads 12*a* to 12*h* are shown in dotted outline) in FIG. 5A. Microcontoller $U_2$ is programmed so that when a faceplate area, i.e. either AREA A, AREA B, AREA C, or AREA D is pressed, the user's command is recognized and further that the appropriate LED is toggled to provide a visual indication that the appropriate faceplate area has been either turned ON or OFF.

In this embodiment, microcontroller $U_2$ is programmed to implement the relationship between touch pads 12*a* to 12*h* and faceplate areas AREA A, AREA B, AREA C, and AREA D illustrated in the following MAP data table:

| Touch Pad | Faceplate Area | Touch Pad | Faceplate Area |
|---|---|---|---|
| 12a | AREA A | 12e | AREA C |
| 12b | AREA A | 12f | AREA C |
| 12c | AREA B | 12g | AREA D |
| 12d | AREA B | 12h | AREA D |

Referring to FIGS. 5A, 5B and 3, there are two indicator LEDs, per area pad which show the area's status. Specifically, LEDs $LED_{12}$ and $LED_{13}$ are used as the "ON" and "OFF" indicators, respectively for faceplate area AREA A; LEDs $LED_1$ and $LED_2$ are used as the "ON" and "OFF" indicators, respectively for faceplate area AREA B; LEDs $LED_3$ and $LED_4$ are used as the "ON" and "OFF" indicators, respectively for faceplate area AREA C; and LEDs $LED_{10}$ and $LED_{11}$ are used as the "ON" and "OFF" indicators, respectively for faceplate area AREA D. In this configuration LED driver $U_3$ is used to drive the eight above-noted LEDs.

Microcontroller $U_2$ executes initial reference frequency measurements (at 130, 132, 134, and 136), calibration steps (at 138, 140, 142, 144, 146, and 148) and the CALIB routine in an identical manner to those discussed above in respect of FIG. 4B. That is, when the user touches a faceplate area AREA A to AREA D, microcontroller $U_2$ will sense which touch pad(s) of touch pads 12*a* to 12*h* have been touched by monitoring changes in frequency of the FREQ signal as part of the CALIB routine illustrated in FIG. 4B and discussed above.

Once CALIB routine returns the variables $TOUCH_1$, $TOUCH_2$, $TOUCH_3$, and $TOUCH_4$, microcontroller $U_2$ will determine which faceplate area of AREA A, AREA B, AREA C, and AREA D, corresponds to the touch pad areas 12*a* to 12*h* which have been determined to have been touched. This determination will be carried out using the relations set out in the above-noted MAP data table (at 150). If microcontroller $U_2$ determines that AREA A has been pressed (at 154), then microcontroller $U_2$ will output a lighting control signal indicating that faceplate AREA A has been pressed (at 156).

Also $LED_{12}$ and $LED_{13}$ will be toggled to indicate to the user that the AREA A faceplate area has been either activated or deactivated (at 158). Similarly, if one of the other faceplate areas are activated (at 160, 166) then the associated data signal will be output (at 162, 168, 172 respectively) and the appropriate LEDs will be toggled (at 164, 170, 174 respectively). In these cases, microcontroller $U_2$ provides the appropriate lighting control signal to connector CON for transmission to a local switching node or to compatible ballast equipment over a lighting network to appropriately control the operation of the user's lighting environment.

It should be noted that in this embodiment, microcontroller $U_2$ has not been programmed to carry out identification of short, long or double activation events on the faceplate areas. Accordingly, it is not necessary to store occurrence or timing event data for further reference. However, microcontroller $U_2$ has been programmed not to allow more than one faceplate area to be activated during one polling cycle (at 152). If more than one AREA has been activated then the routine simply returns to the polling cycle (at 152).

As previously discussed, since the frequency generated by oscillator circuit OSC is still reduced approximately 50 to 60% of the amount which results from the touching of a single pad, this different can still be easily detected using the 94% threshold of the CALIB routine. Accordingly since faceplate area AREA A corresponds to adjacent touch pads 12*a* and 12*b*, if the user touches either (or both) touch pad 12*a* and/or 12*b*, microcontroller $U_2$ will still be able to determine from the change in frequency detected from oscillating circuit OSC, that faceplate AREA A has been activated. Similarly, if user touches either (or both) touch pads 12*c* and/or 12*d*, microcontroller $U_2$ will determine that faceplate area AREA B has been touched, and so on.

Figure 6A:
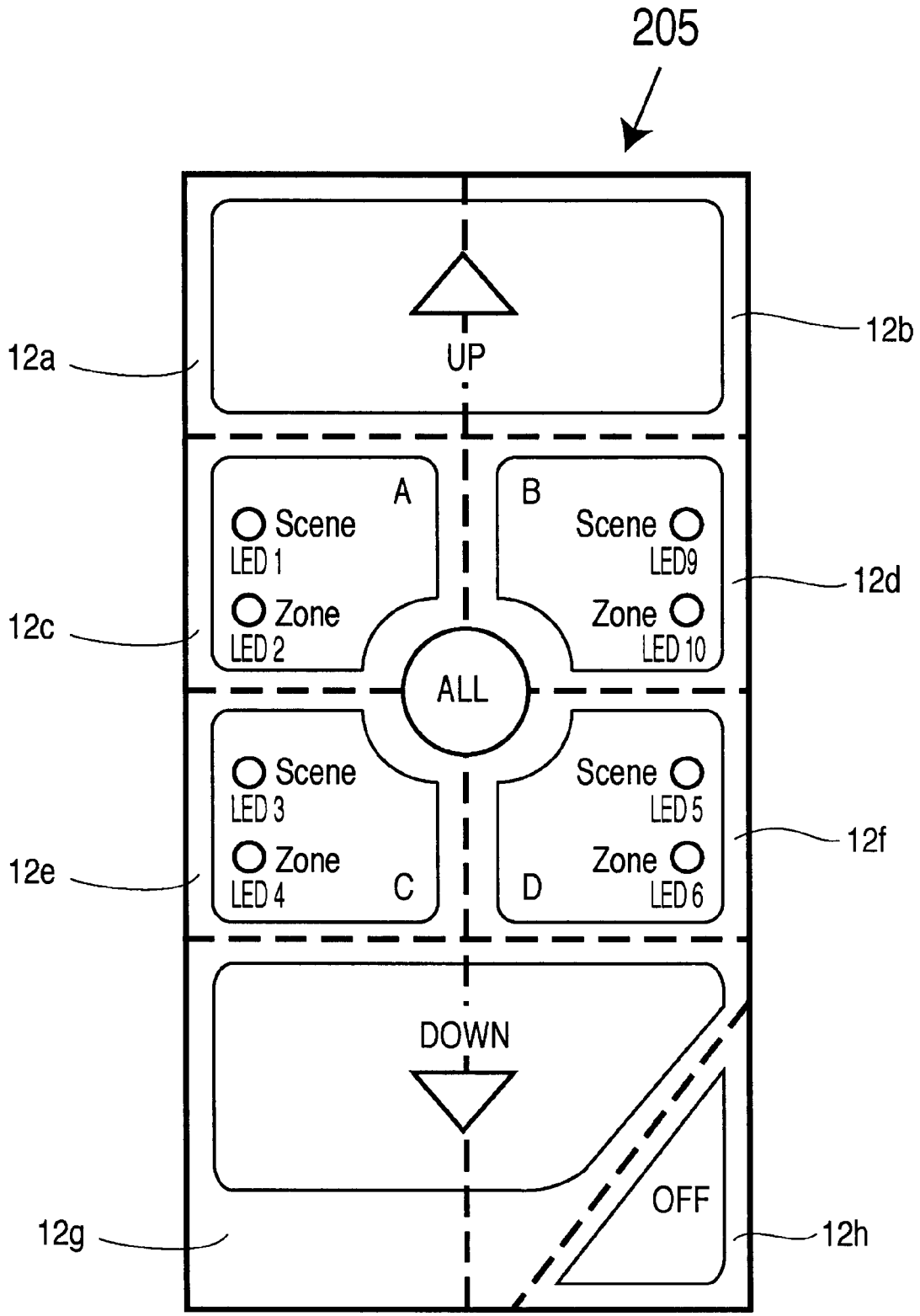
FIG. 6A is another possible faceplate graphical design for the lighting control interface of FIG. 1A.
Figure 6B:
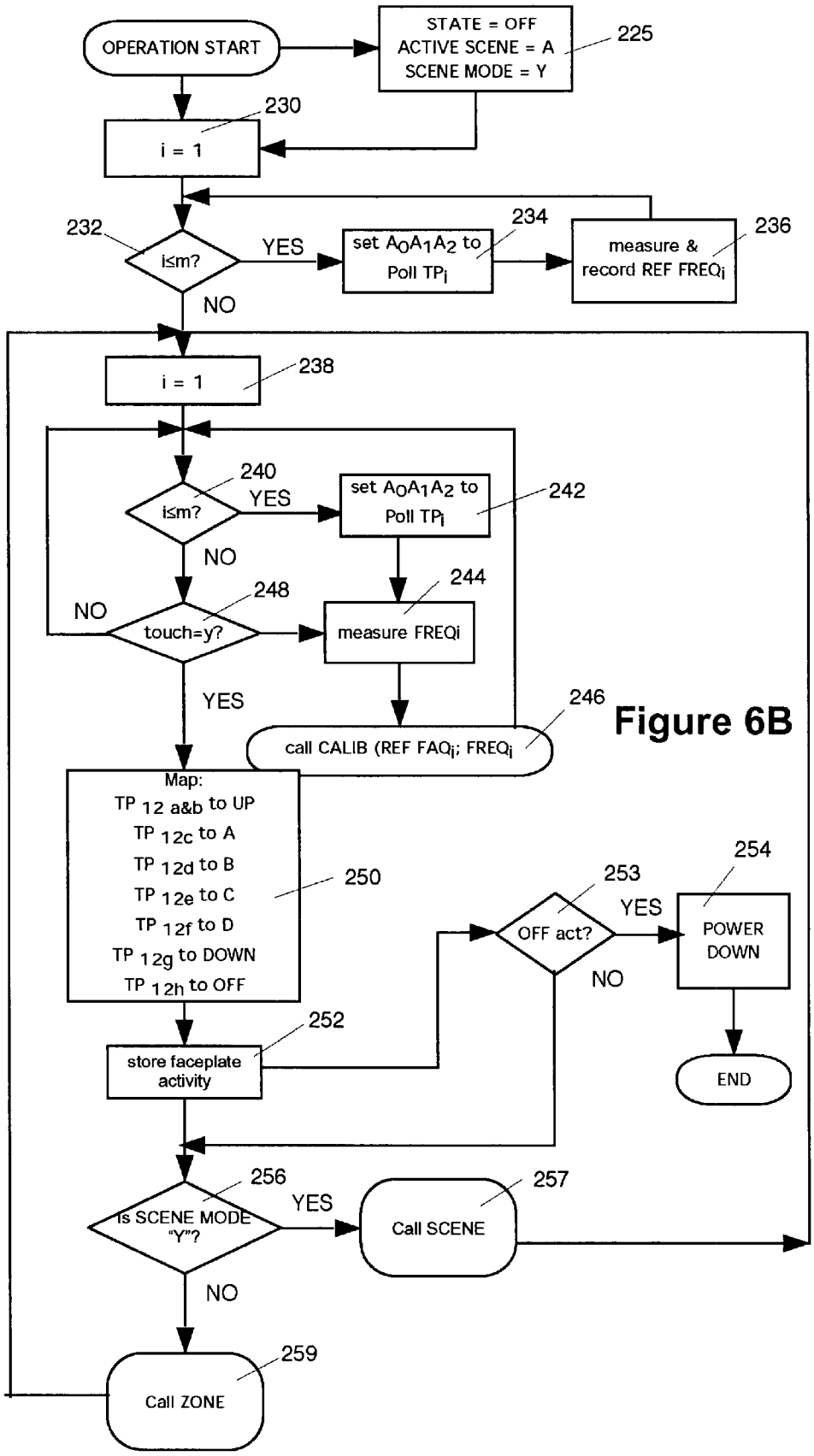
FIG. 6B is a flowchart illustrating the specific operational process steps executed by the microcontroller in order to implement the required functionality for the faceplate of 6A.

FIGS. 6A and 6B illustrate an exemplary switching faceplate 205 that shows how the present invention can be used to provide a customized lighting switching device for what is known as a Zone/Scene setting protocol. Again, for illustrative purposes the individual faceplate areas UP, A, B, C, D, DOWN, and OFF of faceplate 205 are shown in FIG. 6B as being overlain on touch pad matrix 12 (the individual touch pads 12*a* to 12*h* are shown in dotted outline).

In many situations where artificial lighting is used to create an environment conducive to a variety of activities, such as in a hotel lobby; or where it is desirable to emphasize certain features or areas in an architectural space, it is advantageous to be able to control the incident light intensity of the areas independently, so that lighting can be optimized in each area. Areas may be illuminated by groups (or "zones") of lighting fixtures that are controlled together. A control panel, adapted to control power (and, thus light intensity) to each zone, provides a convenient way to create a desired ambience or "scene"; i.e. a particular combination of zone intensities. New scenes are created by adjusting zone intensities to desired lighting levels. Also, it is known to allow more than one zone to be simultaneously selected for simultaneous lighting level adjustment.

Microcontoller $U_2$ is programmed so that when one or more (where appropriate) of the faceplate areas UP, A, B, C, D, ALL, DOWN, and OFF are pressed, the specific user's command is recognized. In this embodiment, microcontroller $U_2$ is programmed to evaluate the mapping information relating touch pads 12*a* to 12*h* to faceplate areas UP, ALL, A, B, C, D, DOWN, and OFF contained in the following MAP data table:

| Touch Pad | Faceplate Area | Touch Pad | Faceplate Area |
|---|---|---|---|
| 12a | UP | 12e | C |
| 12b | UP | 12f | D |
| 12c | A | 12g | DOWN |
| 12d | B | 12h | OFF |
| 12c, 12d, 12e and 12f | ALL | | |

Referring to FIGS. 6A, 6B and 3, there are two indicator LEDs, per area pad A, B, C, and D which show the area's status. Specifically, LEDs $LED_1$ and $LED_2$ are used as the "SCENE" and "ZONE" indicators, respectively for faceplate area A; LEDs $LED_9$ and $LED_{10}$ are used as the "SCENE" and "ZONE" indicators, respectively for faceplate area B; LEDs $LED_3$ and $LED_4$ are used as the "SCENE" and "ZONE" indicators, respectively for faceplate area C; and LEDs $LED_5$ and $LED_6$ are used as the "SCENE" and "ZONE" indicators, respectively for faceplate area D. In this configuration, LED driver $U_3$ is used to drive the eight above-noted LEDs.

Microcontroller $U_2$ executes initial reference frequency measurements (at 230, 232, 234, and 236), calibration steps (at 238, 240, 242, 244, 246, and 248) and CALIB routine in an identical manner to those discussed above in respect of FIG. 4B. That is, when the user touches a faceplate area UP, ALL, A, B, C, D, DOWN, and OFF, microcontroller $U_2$ will sense which touch pad(s) of touch pads 12*a* to 12*h* have been touched by monitoring changes in frequency of the FREQ signal and through execution of the CALIB routine illustrated in FIG. 4B and discussed above.

Once CALIB routine returns the variables $TOUCH_1$ to $TOUCH_7$ microcontroller $U_2$ will determine which faceplate areas correspond to the activated touch pad areas 12*a* to 12*h*. This determination will be carried out using the relations set out in the above-noted MAP data table (at 250). Note that in contrast to the previous exemplary implementation, microcontroller $U_2$ is programmed to allow the simultaneous touching of more than one faceplate area (i.e. the simultaneous touching of A, B, C, and D signifies the "ALL" command). If the user wishes to interrupt power on the line the OFF button can be pressed and the unit will be powered down (at 245).

When lighting control interface 10 is initially powered, it begins in an "OFF" state (i.e. variable STATE=OFF), it is in SCENE mode (i.e. variable SCENE MODE="Y"), and A is the start-up default lighting level (i.e. variable ACTIVE SCENE=A) (at 225). If a user touches any touch pad UP, A, B, C, D, ALL, DOWN, and OFF, then since the variable SCENE MODE is initially "Y" and the variable ACTIVE SCENE is "A" (at 256) the SCENE routine will be called.

Figure 6C:
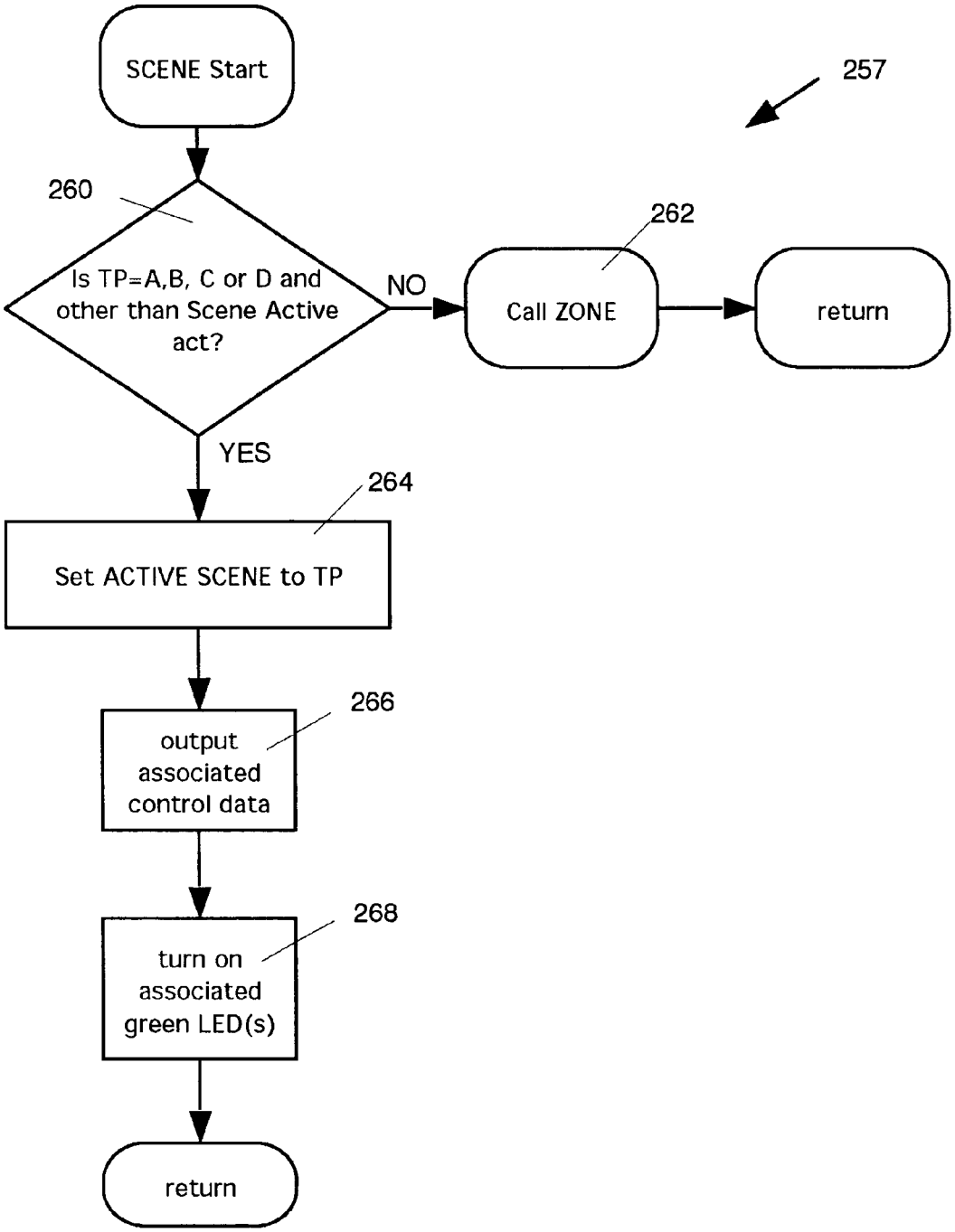
FIG. 6C is a flowchart illustrating the specific operational process steps of the SCENE routine referred to in FIG. 6B.

FIG. 6C illustrates the process steps executed by the SCENE routine. If the variable ACTIVE SCENE is either A, B, C, or D a single button press to any of the three remaining touch pads A, B, C, or D (at 260) will issue a command to set the variable ACTIVE SCENE to be that corresponding value (264) and SCENE MODE will remain "Y". Associated control data is then output (at 266) and the associated green LED is turned on (at 268). Finally, the routine is returned to the OPERATIONAL routine.

If a button is pressed that corresponds to the value of the variable ACTIVE SCENE then the ZONE routine is called (262), the variable ZONE MODE="Y" and the variable SCENE MODE="N". It should be noted that when the variable SCENE MODE is "Y" the UP and DOWN faceplate areas are non-operative (i.e. implements a MAP data table where touch pads 12*a*, 12*b*, and 12*g* are mapped to the active command).

Figure 6D:
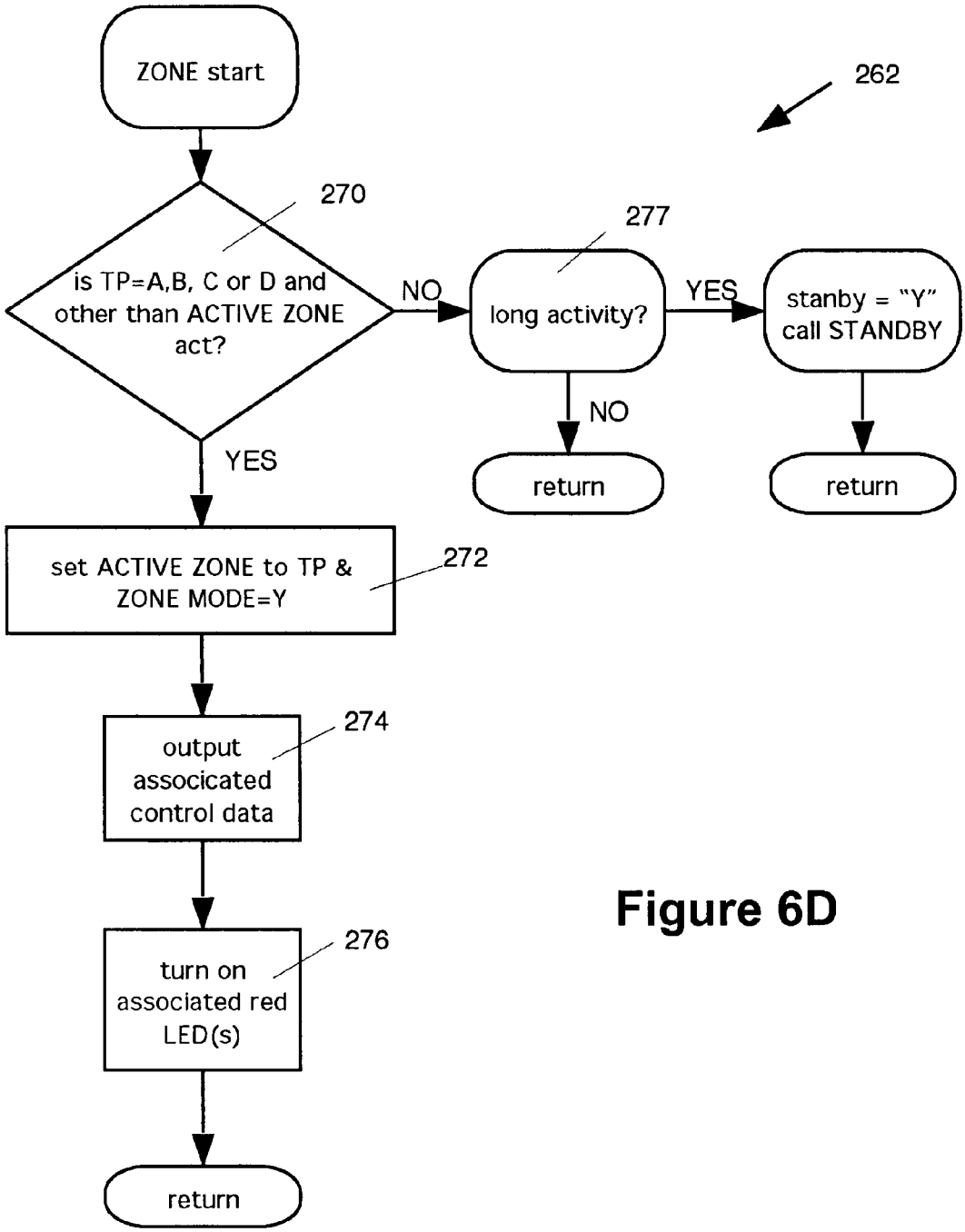
FIG. 6D is a flowchart illustrating the specific operational process steps of the ZONE routine referred to in FIG. 6B.

FIG. 6D illustrates the process steps of the ZONE routine. When the ZONE routine is entered, the four (green) ZONE LEDs (i.e. $LED_2$ $LED_4$, $LED_6$ and $LED_{10}$) are driven to flash prompting the user to select a zone (i.e. A,B,C,D, or ALL). Failure to select a zone in a predetermined time period will result in no action (steps not shown).

As in the SCENE MODE, a single button press of any of touch pad A, B, C, or D other than the current touch pad A, B, C, or D will set the variable ACTIVEZONE=to the touch pad pressed and ZONE MODE will be "Y" (at 270 and 272). Once a zone has been selected and ZONE MODE is changed to "Y" the UP and DOWN buttons can be used to change the light level of the zone (i.e. implementation of a MAP data table where touch pads 12*a* and 12*b* and 12*g* signify the appropriate lighting intensity control signal). Associated control data will be output (274) and the associated red LED(s) will be turned on (276). Finally, the routine is returned to the OPERATIONAL routine via the SCENE routine.

Figure 6E:
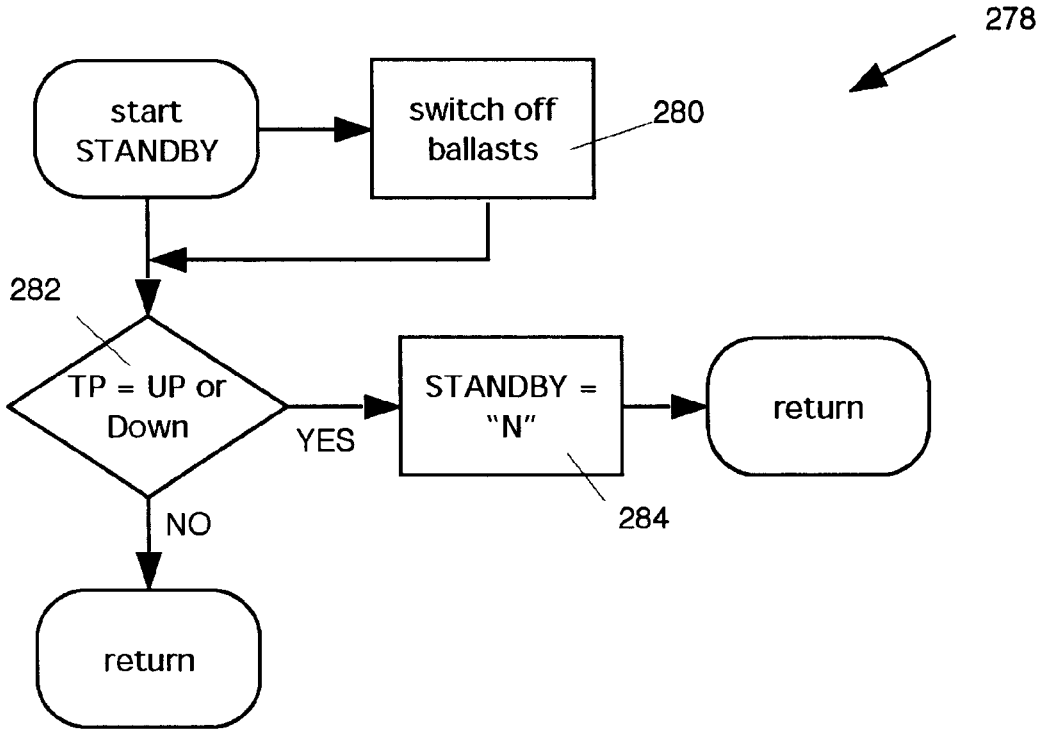
FIG. 6E is a flowchart illustrating the specific operational process steps of the STANDBY routine referred to in FIG. 6D.

Pressing and holding the active zone (i.e. entering a long activation) (at 277) will place the active zone in STANDBY mode (at 278) (FIG. 6E). STANDBY mode is when a ballast (or multiple ballasts) in a zone are switched off electronically without interrupting the power on the line. This allows the user to turn off on/multiple ballasts on the line without effecting the operation of the remaining ballasts or other loads on the line (e.g. incandescent light bulbs). Dimming up brings the ballast out of standby mode (at 282 and 284).

It should be noted that in this embodiment, microcontroller $U_2$ is programmed to carry out identification of a long activation event on the faceplate areas (in the active zone mode). Accordingly, it is necessary to store occurrence or timing event data for further reference. Also, in this embodiment, microcontroller $U_2$ has been programmed to allow more than two faceplate areas to be activated during one polling cycle (at 252).

In use, lighting control interface 10 is configured for a particular lighting installation by appropriately programming microcontroller $U_2$ to support the particular functionality of the faceplate and by installing or sliding the corresponding faceplate 15 into housing 14. The user then touches the faceplate areas as instructed. By polling the touch pads, control circuit 16 will be able to determine the appropriate user command and will accordingly transmit this lighting control data either to local lighting control/dimming equipment or to a lighting computing network for more complex lighting environment control.

Accordingly, lighting control interface 10 provides lighting manufacturers with a high degree of flexibility to provide customized lighting control equipment for different types of lighting environments. Specifically, as previously discussed, the graphical design printed on faceplate 15 reflects a particular type of lighting control functionality and control circuit 16 can be appropriately programmed to support this particular lighting control functionality. In this way, it is possible to adapt lighting control interface 10 to a new lighting environment (i.e. where additional user command functionality is required) through the simple process of redesigning faceplate 15 to include the additional commands for user selection and by re-programming the microcontroller of control circuit 16 to appropriately read and implement the additional commands from faceplate 15. In contrast, prior art systems, would require additional installation of hardware components. Accordingly, lighting control interface 10 provides an extremely time and cost effective method of lighting control for a wide range of different lighting systems. Finally, since lighting control interface 10 is made of a minimal number of relatively inexpensive components, it can be manufactured easily and inexpensively.

Finally, as discussed above, while the figures below set forth a single lighting control interface 10, it should be understood that a plurality of lighting control interfaces 10 could be adapted for used within a networked centralized computer-based lighting system. Further, is also contemplated that a series of preprogrammed physical "plug-in" modules (i.e. including the appropriately programmed microcontroller $U_2$) can be developed for insertion into a standardized housing for use in association with a series of faceplates 15. In this way, users can easily order maintain and change lighting control interface 10 as changes are made to their lighting environment. Users can even be provided with a desktop software application that would facilitate the printing of customized faceplates for use with the various preprogrammed modules.

As will be apparent to persons skilled in the art, various modifications and adaptations of the structure described above are possible without departure from the present invention, the scope of which is defined in the appended claims.

We claim:

1. A lighting control interface comprising:

(a) a touch pad matrix containing a plurality of touch pads;

(b) a programmable device coupled to said touch pad matrix such that said programmable device can be programmed to ascribe a first set and a second set of functions to said touch pads, said first and second sets of functions being different from each other; and (c) said touch pad matrix being capable of receiving at least two different faceplates, one of said faceplates containing a first unique arrangement of graphics that correspond to said first set of functions and another of said faceplates containing a second unique arrangement of graphics that correspond to said second set of functions.

2. The lighting control interface of claim 1 wherein said programming device comprises a microcontroller.

3. The lighting control interface of claim 1 further comprising a plurality of LEDs mounted adjacent to said touch pad matrix, said plurality of LEDs being adapted to visually signal the operational status of at least said first set of functions and said second set of functions.

4. The lighting control interface of claim 1 wherein each of said at least two faceplates include:

(a) a flexible sheet;

(b) a conductive layer formed on the underside of said flexible sheet; and (c) a dielectric layer formed on top of said conductive layer, such that the underside of said faceplate is adapted to physically interface with said touch pad matrix to form capacitive switches.

5. The lighting control interface of claim 4 wherein said dielectric layer is formed of distinct dots of dielectric material.

6. The lighting control interface of claim 4 wherein said flexible sheet is transparent and wherein said conductive layer contains openings so that each of said at least two faceplates contain regions which are transparent.

7. The lighting control interface of claim 1 wherein said touch pad matrix and the programmable device are adapted to fit within a housing, said housing being sized to fit within the space of a conventional light switch mounting box.

8. A method of configuring a lighting control interface having a plurality of touch pads coupled to a programmable device, said programmable device being capable of being programmed to ascribe a first set and a second set of functions to said touch pads, said first set and second set of functions being different from each other, said method comprising the steps of:

(a) programming the programmable device to ascribe one of said first set and second set of functions to said touch pads;

(b) creating a first faceplate with a first unique arrangement of graphics corresponding to said one set of functions; and (c) attaching said faceplate over said plurality of touch pads.

9. The method of claim 8 wherein step (b) includes the steps of:

(a) providing a flexible sheet;

(b) forming a conductive layer on the underside of said flexible sheet; and (c) forming a dielectric layer on top of said conductive layer, such that the underside of said faceplate is adapted to physically interface with said touch pad matrix to form capacitive switches.

10. The method of claim 8, further comprising the steps of:

(d) creating a second faceplate having a second unique arrangement of graphics corresponding to said other set of functions, said first and said second unique arrangement of graphics being different from each other; and (e) reprogramming the programmable device to ascribe the other of said first set and second set of functions to said touch pads.

* * * * *